US006785989B2

(12) United States Patent
Rienzo et al.

(10) Patent No.: US 6,785,989 B2
(45) Date of Patent: Sep. 7, 2004

(54) METHODS AND APPARATUS FOR REMOVAL OF WRINKLES FROM FABRICS

(75) Inventors: Paul Eugene Rienzo, Cincinnati, OH (US); Michael Joseph Orr, West Chester, OH (US); Brian Daniel Guzzi, Cincinnati, OH (US); Dean Larry DuVal, Lebanon, OH (US); Jacqueline Nicole Ouellette, San Francisco, CA (US)

(73) Assignee: The Procter & Gamble Company, Cincinnati, OH (US)

( * ) Notice: Subject to any disclaimer, the term of this patent is extended or adjusted under 35 U.S.C. 154(b) by 133 days.

(21) Appl. No.: 09/817,540

(22) Filed: Mar. 26, 2001

(65) Prior Publication Data

US 2002/0000054 A1 Jan. 3, 2002

Related U.S. Application Data

(60) Provisional application No. 60/193,763, filed on Mar. 31, 2000, and provisional application No. 60/233,059, filed on Sep. 14, 2000.

(51) Int. Cl.[7] ..... D06F 75/22

(52) U.S. Cl. ..... 38/77.1; 38/77.3

(58) Field of Search ..... 116/137 R, 137 A; 310/320, 321, 322, 324; 38/74, 77.1, 77.3, 77.5, 82, 94, 77.7, 77.8, 77.83; 219/209, 210, 227, 245, 254

(56) References Cited

U.S. PATENT DOCUMENTS

| | | | | | |
|---|---|---|---|---|---|
| 2,079,708 | A | * | 5/1937 | Hart, Jr. | 34/254 |
| 3,342,076 | A | | 9/1967 | Bodine | |
| 3,357,033 | A | | 12/1967 | Sawyer | |
| 4,308,229 | A | | 12/1981 | Voit | |
| 4,448,750 | A | | 5/1984 | Fuesting | |
| 4,646,451 | A | * | 3/1987 | Nakao et al. | 38/77.3 |
| 4,656,763 | A | * | 4/1987 | Kawasaki et al. | 38/77.83 |
| 4,823,713 | A | * | 4/1989 | Ogawa et al. | 112/217 |
| 4,928,611 | A | | 5/1990 | Ogawa | |
| 5,094,021 | A | * | 3/1992 | Chen | 38/82 |
| 5,297,512 | A | | 3/1994 | Sharp | |
| 5,311,632 | A | | 5/1994 | Center | |
| 5,350,457 | A | | 9/1994 | Kitazawa et al. | |
| 5,369,831 | A | | 12/1994 | Bock | |
| 5,372,741 | A | | 12/1994 | Tomaszewski | |
| 5,464,477 | A | | 11/1995 | Awad | |
| 5,529,788 | A | | 6/1996 | DeSenna | |
| 5,546,624 | A | | 8/1996 | Bock | |
| 5,770,550 | A | | 6/1998 | Motson | |
| 5,890,249 | A | | 4/1999 | Hoffman | |
| 6,009,645 | A | * | 1/2000 | Shimizu et al. | 38/77.5 |
| 6,035,563 | A | * | 3/2000 | Hoefer et al. | 38/77.1 |
| 6,128,839 | A | * | 10/2000 | Debourg et al. | 38/77.8 |

FOREIGN PATENT DOCUMENTS

| | | |
|---|---|---|
| DE | 3610386 A1 | 10/1987 |
| FR | 1102562 | 10/1955 |
| FR | 2 771 424 A1 | 5/1999 |
| GB | 2204321 A | 11/1988 |
| JP | 45-13193 | 5/1970 |
| JP | 59-009281 | 1/1984 |
| JP | 61-249500 | 11/1986 |
| JP | 04-050361 | 2/1992 |
| JP | 07-047197 | 2/1995 |
| JP | 97-308516 | 12/1997 |
| RU | 2083745 C1 | 7/1997 |
| WO | WO 97/16263 | 5/1997 |
| WO | WO 97/26821 | 7/1997 |

* cited by examiner

*Primary Examiner*—Ismael Izaguirre
(74) *Attorney, Agent, or Firm*—Jeffrey V. Bamber; Julia A. Glazer; Brent M. Peebles

(57) ABSTRACT

The present invention generally relates to devices, methods and product for removing wrinkles and smoothing fabric, especially articles of clothing, linen and drapery, using ultrasonic energy and an ultrasonic transmission fluid.

20 Claims, 1 Drawing Sheet

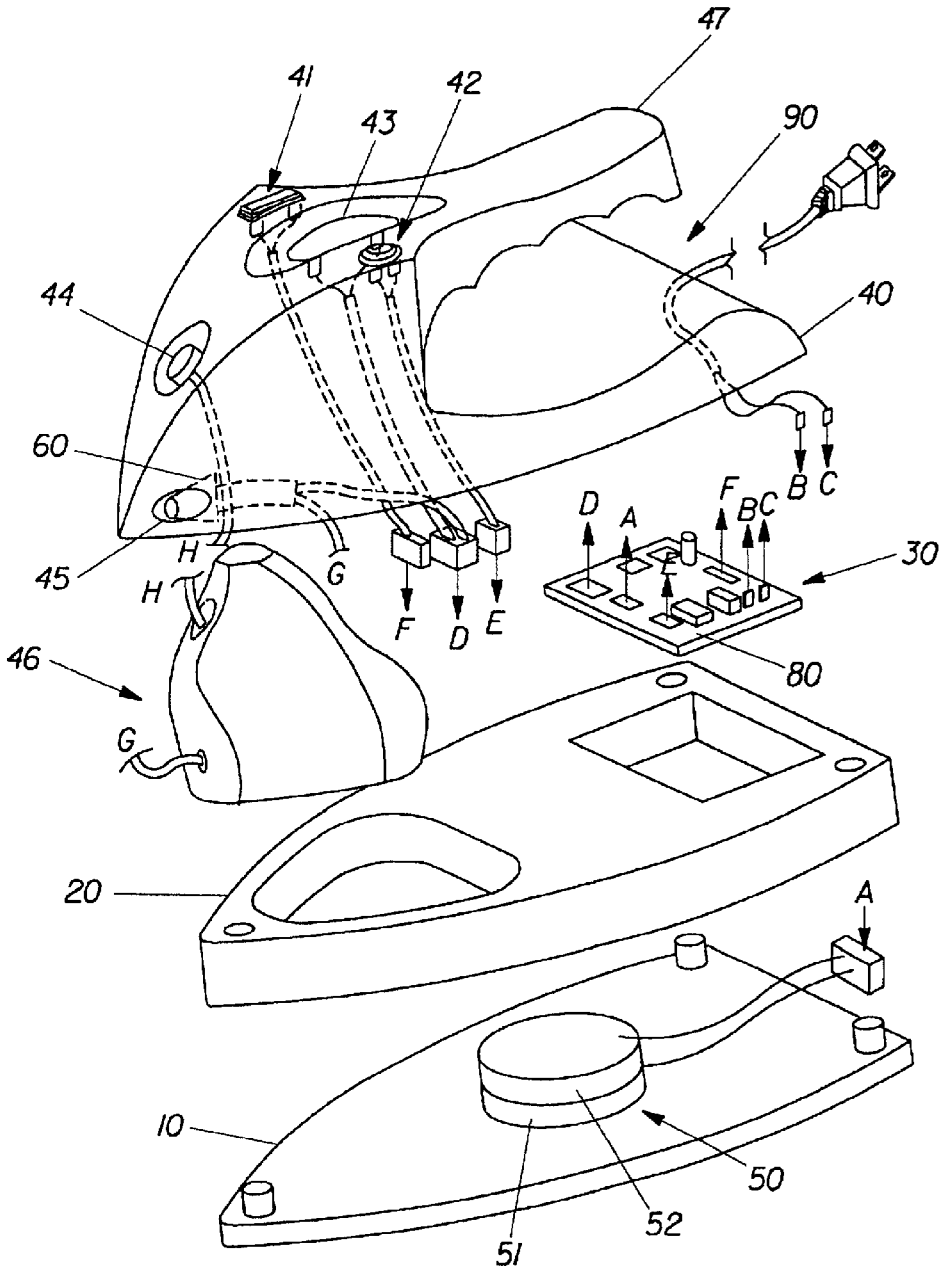
47
41
42
43
90
44
40
60
B
C
D
A
F
B
C
30
45
H
G
E
F
D
E
80
46
H
G
20
A
10
50
52
51

METHODS AND APPARATUS FOR REMOVAL OF WRINKLES FROM FABRICS

This application claims the benefit of provisional U.S. patent application Ser. No. 60/193,763 filed Mar. 31, 2000 and U.S. patent application Ser. No. 60/233,059, filed Sep. 14, 2000.

FIELD OF THE INVENTION

The present invention relates to devices, methods and products for removing wrinkles and smoothing fabric, especially articles of clothing, linens and draperies.

BACKGROUND OF THE INVENTION

Removal of wrinkles by the time-honored technique of pressing wrinkled fabrics or clothing calls for an ironing board and a hot iron to remove the wrinkles. While this method certainly works, it can be not only potentially damaging to the wrinkled fabrics or clothing, but also to the user. The risk of injury, to young children, let alone skilled adult users, is further compounded by the ever-present risk of fire from a neglected iron. Even an iron that has been turned off presents significant risk of injury to an inattentive or unaware individual. A stored cold iron is another risk of injury to the unwary.

Furthermore, different fabrics require different temperatures to smooth and de-wrinkle. For example, the heat required to smooth and de-wrinkle a polyester garment, would prove ineffective on a similar cotton garment. Conversely, the heat required to smooth and de-wrinkle a cotton garment would damage or even destroy a similar polyester garment. Potential traps for the unwary abound. For example, a cotton shirt may be damaged because the heat needed to iron the shirt is sufficient to melt the polyester thread used to affix an emblem to the shirt. Likewise, time is wasted while an iron is cooling after ironing heavy fabric, such as denim, for its subsequent safe use on another fabric, say, polycotton or rayon.

Many alternatives have been suggested to this time-honored technique of pressing wrinkled fabrics or clothing. Various methods of de-wrinkling and smoothing have been suggested, such as, smoothing by hand, steam de-wrinkling devices, fogging cabinets, and techniques using tension or stretching devices in combination with aqueous solutions. While smoothing by hand eliminates the risk to both the user and the fabric from heat, it is laborious, time consuming and difficult to reproduce results comparable to those obtained from a convention iron. Steam de-wrinkling devices can produce results comparable to a conventional iron, but they have similar safety issues to conventional irons and may not be suitable for all fabric types. Fogging devices and techniques using tension or stretching in combination with aqueous solutions employing apparatus that entail a substantial financial outlay and produce results that can be obtained for far less cost with a conventional iron.

Another alternative is de-wrinkling by ultrasonics. Ultrasonics has been used in irons in two ways. In the first, an ultrasonic wave is generated in a metal body that is bonded to a second metal body. The resulting movement of one metal body against another generates friction and consequently heat, which can be then used to remove wrinkles by otherwise conventional pressing techniques. While this system provides instant heat at the desired temperature, it also suffers from the problems associated with conventional irons, namely safety and fiber damaging heat that can scorch, "shine" or flatten the fabric. A second way is to generate an ultrasonic wave in a metal body and to move the body over a fabric in such a way as to create friction between the metal body and the fabric sufficient to generate enough heat to iron the fabric. Alternatively, the fabric is moved between a hammer, in which an ultrasonic wave is generated, and an anvil. The movement of the fabric relative to the hammer and anvil generate sufficient friction between the hammer, anvil and fabric to heat the fabric and remove wrinkles. Again, this is problematic in that heat is used which could damage the fiber by scorching, shining or flattening the fabric. The need for the user to constantly exert pressure means the potential need exists to repeatedly pass the fabric through the hammer/anvil apparatus because insufficient pressure has been exerted to generate sufficient heat to remove the wrinkles in a single pass.

Accordingly, there remains a need for a way of smoothing and de-wrinkling fabric that does not use fiber-damaging heat that scorches shines or flattens the fabric.

BACKGROUND ART

U.S. Pat. No. 5,094,021, issued Mar. 10, 1992; U.S. Pat. No. 4,928,611, issued May 29, 1990; U.S. Pat. No. 4,823,713, issued Apr. 25, 1989; RU Application No. 2083745C1 published Jul. 10, 1997; JP Application No. 9-308516, published Dec. 2, 1997; JP Application No. 59-9281, published Jan. 18, 1984; and JP Application No. 45-13193, published May 13, 1970.

SUMMARY OF THE INVENTION

The present invention relates to a product, device and method for smoothing and de-wrinkling fabric which does not use fiber damaging heat which scorches shines or flattens the fabric, is suitable for use on all fabric types and can even be used to smooth and de-wrinkle fabrics while they are worn by the user.

In accordance with a first aspect of the present invention, a method for smoothing and de-wrinkling a discrete fabric item is provided. The method comprises the steps of applying to the wrinkled area of the fabric item an effective amount of an ultrasonic transmission fluid and concurrent with or subsequent to the application of the ultrasonic transmission fluid, applying a source of ultrasonic energy to the ultrasonic transmission fluid, wherein the source of ultrasonic energy is applied in a manner which avoids fiber-damaging heat which could scorch, shine or flatten fabric.

In accordance with a second aspect of the present invention, a method for smoothing and de-wrinkling a discrete fabric item is provided. The method comprises at least the steps of: (A) applying to the wrinkled area of the discrete fabric item a quantity of an ultrasonic transmission fluid which is from about 1% to about 200% the dry weight of the wrinkled area of the discrete fabric item; and (B) concurrently with or subsequently to step (i) applying a source of ultrasonic energy to the ultrasonic transmission fluid, wherein the source of ultrasonic energy is applied in a manner which avoids fiber-damaging heat which could scorch, shine or flatten fabric.

In accordance with a third aspect of the present invention, a discrete fabric item smoothing de-wrinkling product is provided. The product which smoothes and de-wrinkles discrete fabric item without using fiber damaging heat which could scorch, shine or flatten discrete fabric item comprises:

(a) ultrasonic transmission fluid, comprising an ultrasonic carrier and, optionally, an ultrasonic adjuvant;

(b) an ultrasonic wave generating source for imparting ultrasonic waves onto wrinkles in the discrete fabric item; and (c) instructions for using the product comprising the steps of:

(i) applying an effective amount of said ultrasonic transmission fluid to the wrinkles; and (ii) imparting ultrasonic waves to the wrinkles using the ultrasonic source in a manner that avoids fiber-damaging heat that could scorch, shine or flatten fabric.

Surprisingly, it has now been discovered that the present invention provides a wholly unexpected benefit beyond that of smoothing wrinkled fabrics. All fabrics are made from threads that, themselves, are comprised of macrofibers. After repeated wearing and laundering, such macrofibers begin to disassociate and form so-called microfibrils. This is especially true with cellulosics, such as, cotton, but can also occur with other natural, synthetic and blended fabrics. Once formed, these microfibrils form a type of haze on the fabrics that tends to dull the brightness of dyes. As a result, the fabrics look old dull and "washed-out".

In accordance with a fourth aspect of the present invention, a process for restoring the appearance of fabrics is provided. The method, which restores the appearance of fabrics by removing and/or restoring microfibrils to the macrofibers of a fabric article, comprises the steps of:

(a) applying an effective amount of an ultrasonic transmission fluid to the fabrics; and (b) imparting sonic or ultrasonic waves to the fabrics in a manner which avoids fiber-damaging heat which could scorch, shine or flatten fabric;

wherein the fabrics contains from about 1% to about 200% the dry weight of the fabrics of ultrasonic transmission fluid.

In accordance with a fifth aspect of the present invention, a product for restoring the appearance of fabrics is provided. The product which restores the appearance of fabrics by removing and/or restoring microfibrils to the macrofibers of a fabric article, comprises:

(a) ultrasonic transmission fluid, comprising an ultrasonic carrier and, optionally, an ultrasonic adjuvant;

(b) an ultrasonic wave generating source for imparting ultrasonic waves onto the fabrics; and (c) instructions for using the product comprising the steps of:

(i) applying an effective amount of an ultrasonic transmission fluid to the fabrics; and (ii) imparting ultrasonic waves to the fabrics using the ultrasonic source in a manner that avoids fiber-damaging heat that could scorch, shine or flatten fabric.

In accordance with a sixth aspect of the present invention, an ultrasonic de-wrinkling apparatus is provided. The ultrasonic de-wrinkling apparatus comprises, a plate; ultrasonic means attached to the plate for generating ultrasonic waves in the plate; a housing attached to the plate having handle means for grasping the housing and moving the housing and the plate on the fabric; and means to prevent the generation of heat in the plate by the moving of the plate on the fabric.

In accordance with a seventh aspect of the present invention, a discrete fabric item smoothing de-wrinkling product is provided. The product which smoothes and de-wrinkles discrete fabric item without using fiber damaging heat which could scorch, shine or flatten discrete fabric item comprises:

(a) ultrasonic transmission fluid, comprising an ultrasonic carrier and, optionally, an ultrasonic adjuvant;

(b) ultrasonic de-wrinkling apparatus comprising, a plate; ultrasonic means attached to the plate for generating ultrasonic waves in the plate; a housing attached to the plate having handle means for grasping the housing and moving the housing and the plate on the fabric; and means to prevent the generation of heat in the plate by the moving of the plate on the fabric; and (c) instructions for using the product comprising the steps of:

(i) applying an effective amount of said ultrasonic transmission fluid to the wrinkles; and (ii) imparting ultrasonic waves to the wrinkles using the ultrasonic de-wrinkling apparatus in a manner that avoids fiber-damaging heat that could scorch, shine or flatten fabric.

As used herein, the phrase "smoothing and de-wrinkling" means to significantly reduce unevenness on the surface of an object that is caused by the cleaning or use of a fabric or garments.

As used herein, the phrase "scorch" fabric, means to burn slightly so as to change color of, shrivel or parch the fabric.

As used herein, the phrase "shine" fabric means to make bright, glossy or polish by reducing the height or depth of the fibers in the fabric article; by reorientation of the fibers in such a fashion as to increase reflectance of light from the fabric in a specific direction; or by changing the shape, and consequently the visual properties of the fibers, by partially melting the macrofibers.

As used herein, the phrase "flatten" fabric means to reduce the height or depth of the fibers in the fabric article to an extent that the reduction in height or depth is perceivable visually as such; the fabric has been visually reduced in depth; or the fabric has a less diffuse reflectance as compared to the untreated fabric.

As used herein, the phrase "ultrasonic waves" means mechanical pressure or stress waves that can propagate through any material media, wherein the frequency spectra of these waves can vary from a few cycles/second (Hz) to a few billion Hz.

These and other aspects, features and advantages will be seen to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are, in relevant part, incorporated herein by reference.

BRIEF DESCRIPTION OF THE DRAWING

In the accompanying drawing:

FIG. 1 is an exploded perspective view of an ultrasonic de-wrinkling apparatus in accordance with one embodiment of this invention.

DETAILED DESCRIPTION OF THE INVENTION

FIG. 1 shows an exploded perspective view of an ultrasonic de-wrinkling apparatus 90 of the present invention. The apparatus 90 includes a plate or sole plate 10, an isolating base 20, housing 40, and an ultrasonic transducer 50.

The sole plate 10, having a shape approximating a triangle, is be made of material with good acoustic properties. Such acoustically suitable material includes, but is not limited to, aluminum alloys, steel, titanium or other suitable material with good acoustic properties. One suitable aluminum alloy is, 7075 aluminum available from American Metal Supply Co. Cincinnati, Ohio.

Housing 40, comprise therein a handle 47, and "ON/OFF" switch 41, a warning light 42, a spray trigger 43, a spray outlet 45 and a reservoir inlet 44. The reservoir inlet 44, and spray outlet 45 are within fluid communication of one another through the reservoir 46. The reservoir 46 stores the ultrasonic transmission fluid in the apparatus 90 is located within the isolating base 20. Ultrasonic transmission fluid is added to the apparatus 90 in the following manner: The ultrasonic transmission fluid is poured through the reservoir inlet 44 and into reservoir 46. The apparatus 90 may either automatically dispense the ultrasonic transmission fluid through the spray outlet 45 onto the fabric, or the user may dispense the ultrasonic transmission fluid on to the fabric by pressing the spray trigger 43 and thereby dispensing the ultrasonic transmission fluid onto the fabric. Application of the ultrasonic transmission fluid to the fabric from reservoir 46 can be prior to or concurrent with the application of ultrasonic energy from the apparatus 90.

Along with the reservoir 46, the ultrasonic controller 30, is located within the isolating base 20. The main purpose of the isolating base 20 is to isolate the ultrasonic controller 30, reservoir 46, and the operator from the ultrasonic vibration generated while the apparatus 90 is being used. This is to extend the life of the electrical circuitry and to isolate as much as possible the user from any vibration.

The ultrasonic source comprises an ultrasonic transducer 50, a top piezoelectric material 52 and a bottom piezoelectric material 51. The bottom piezoelectric material 51 is fixedly mounted on the top piezoelectric material 52, which, in turn, fixedly mounted on the ultrasonic transducer 50 which, in turn, is fastened securely to sole plate 10 by means of an epoxy resin adhesive.

On the ultrasonic controller 30, is means to prevent the generation of heat 80. This means may be selected from the group consisting of temperature means, pressure means, and electronic means. Suitable temperature means includes, thermal resistors, strain gauges or the like. For example, when the means to prevent the generation of heat 80 reaches a specific temperature the means 80 changes resistivity properties and triggers a signal that would prevent current from flowing across the top piezoelectric material 52 and the bottom piezoelectric material 51. The current is withheld from the ultrasonic transducer 50, until the sole plate 10 temperature drops sufficient enough for the user to apply ultrasonic energy from the apparatus 90 to the fabric without applying fiber-damaging heat that could scorch, shine or flatten fabric. Alternatively, upon reaching a specific temperature a thermal resistor could prevent current being sent across the top piezoelectric material 52 and the bottom piezoelectric material 51. Current flow would be restored when the temperature dropped below the specific temperature.

An alternative temperature means are strain gauges. Strain gauges would not be located on the ultrasonic controller 30 as illustrated by the means prevent the generation of heat 80 in FIG. 1. A strain gauge would be affixed to the inner surface of the sole plate 10 by an adhesive, typically epoxy adhesive. If the sole plate 10 were to heat up, it would expand. The strain gauge would expand with the sole plate 10. The resulting strain in the strain gauge will change its geometry and in turn the strain gauges resistive properties. The voltage potential is then withheld from the ultrasonic transducer 50, until the sole plate 10 temperature drops sufficient enough for the user to apply ultrasonic energy to the fabric without applying fiber-damaging heat, which could scorch, shine or flatten fabric.

Suitable pressure means includes, a load cell, piezoelectric material that would generate an electrical signal proportional to the pressure loading. If an excessive amount of pressure were used in applying the apparatus 90, to the fabric article it would generate an electrical signal from the load cell. This electrical signal would trigger a signal from the means prevent the generation of heat 80 the voltage potential is then withheld from the ultrasonic transducer 50, until the pressure applied sole plate 10 temperature drops sufficient enough for the user to apply ultrasonic energy from the apparatus 90 to the fabric without scorching, shining or flattening.

Suitable electronic means includes, current or power monitoring from the ultrasonic transducer generator circuit on the ultrasonic controller 30. Excessive current or power requirements typically indicates an increase of sole plate temperature. Excessive current or power requirements triggers a signal from the means for preventing the generation of heat 80, current is then withheld from the ultrasonic transducer 50, until the sole plate 10 temperature drops sufficient enough for the user to apply ultrasonic energy from the apparatus 90 to the fabric without scorching, shining or flattening.

Also within the scope of the present invention are smoothing and de-wrinkling devices that are much larger than the device illustrated in FIG. 1 and/or have additional ultrasonic wave outputs so as to facilitate treating fabric with relatively large surface areas e.g. entire garments.

The invention encompasses, in one embodiment, a smoothing and wrinkle removal product essentially comprising an ultrasonic transmission fluid, an ultrasonic wave source and instructions for their use. By using this product, wrinkles from clothes can be removed without the use of mechanical force or other manipulation that produces fiber damaging heat. In doing so, the user does not need to impart mechanical energy to generate heat to remove the wrinkles or smooth the fabric thereby adding to the convenience and safety of the user. The invention also encompasses processes by which such wrinkles are removed, either from localized regions or from the entire article to be smoothed and de-wrinkled. Furthermore, the process of the present invention may be performed on fabric articles, such as shirts, pants, kilts, blouses, suits, etc., while a human being is wearing them. This means a user may remove a troublesome wrinkle without removing the article of clothing. This further means that the methods, products and devices of the present invention can be used in any location which is convenient to the user and could potentially eliminate the need for an ironing board or the like.

According to the invention, the ultrasonic wave-generating source is used to impart ultrasonic waves onto the wrinkle to affect its removal from the wrinkled garment. While not intending to be limited by theory, it is believed that the combination of the ultrasonic transmission fluid and the source of ultrasonic energy temporarily disrupts or breaks the hydrogen bonds present between the fibers in the fabric, thereby allowing the fabric to be smoothed and de-wrinkled. This eliminates the need for the use of force, rubbing, pressure or other manipulation that produces fiber-damaging heat, via friction, which scorches shines or flattens the material.

The smoothing and de-wrinkling product of the present invention includes instructions for using the product which preferably comprises the steps of: applying an effective amount of the ultrasonic transmission fluid to the wrinkle; imparting ultrasonic waves to the wrinkles using the ultrasonic source in a manner which avoids fiber-damaging heat which could scorch, shine or flatten fabric. The phrase "effective amount" means an amount of the ultrasonic transmission fluid sufficient to allow ultrasonic energy transmitted to the wrinkle to remove the wrinkle. This amount can vary dramatically if the wrinkled area is very large, for example, on a large area of a garment in which case much more of the composition will be needed to saturate the wrinkled area. Similarly, the type of fabric will also be a factor in how much transmission fluid is required to remove any wrinkles. Typically, it is preferred that the amount of ultrasonic transmission fluid required to remove any wrinkles is at least about 1%, more preferably at least about 2%, even more preferably, at least about 5% even more preferably still, at least about 10% by the dry weight of the wrinkled area of the discrete fabric item. It is also it is preferred that the amount of ultrasonic transmission fluid required to remove any wrinkles contain is less than or equal to about 200%, more preferably less than or equal to about 150%, even more preferably, less than or equal to about 100%, even more preferably still, less than or equal to about 50% the dry weight of the wrinkled area of the discrete fabric item.

The ultrasonic wave-generating source can be separate from the ultrasonic transmission fluid, or they may be contained together in a device that permits controlled dispensing of the ultrasonic transmission fluid to the wrinkle while concurrently imparting ultrasonic waves thereto. Such a device may optionally include removable cartridges in which is contained the ultrasonic transmission fluid.

In one mode, the fabric is washed and spun-dried to the damp state in an automatic washing machine. The moisture in the damp fabric serves as the ultrasonic transmission fluid. The wrinkled, damp fabric is then subjected to ultrasonic waves in the manner discussed herein to achieve the de-wrinkling benefit.

In one embodiment of the present invention the methods, products and devices of the present invention can be used in conjunction with traditional ironing boards. Alternatively, in another embodiment of the present invention the methods, products and devices of the present invention can be used in conjunction with a surface which does not dissipate the ultrasonic energy transmitted through the fabric, but instead which reflects the energy back to through the fabric, thereby increasing overall efficiency and efficacy. Suitable surfaces include, but are not limited to: Any surface that will not significantly dampened the ultrasonic energy being provided to the fabric article. Materials with volumes that are made up of greater than 1% air are desired. Examples include mesh screen, netting, ironing boards, and human skin.

The garment smoothing and de-wrinkling product of the present invention includes instructions for using the product. These instructions may be present in the product in a variety of different ways. The instructions may be in the form of words, symbols, images, pictures or any possible combination of these, with words or words and images or pictures preferred. For example they can be printed on the outside and/or inside of a package in which the product is contained; printed on a piece of paper, cardboard or plastic and placed in the package in which the garment smoothing and de-wrinkling product is contained; and/or printed on the ultrasonic wave generating source, or combinations of some or all of these or presented in a different manner including, but not limited to, a brochure, print advertisement, electronic advertisement, and/or verbal communication, so as to communicate the set of instructions to a consumer of the article of manufacture, namely the ultrasonic transmission fluid and the ultrasonic wave generating source.

In one aspect of this embodiment of the present invention the instructions comprise:

(i) applying an effective amount of an ultrasonic transmission fluid to the fabrics; and (ii) imparting ultrasonic waves to the fabrics using the ultrasonic source in a manner that avoids fiber-damaging heat that could scorch, shine or flatten fabric.

In another aspect of this embodiment of the present invention the instructions comprise at least the steps of:

(i) touching the surface of the ultrasonic source, for example the plate of the ultrasonic de-wrinkling apparatus of the sixth aspect of the present invention, to determine if the ultrasonic source is active, that is generating ultrasonic energy ready to de-wrinkle fabrics;

(ii) applying an effective amount of an ultrasonic transmission fluid to the fabrics; and (iii) imparting ultrasonic waves to the fabrics using the ultrasonic source in a manner that avoids fiber-damaging heat that could scorch, shine or flatten fabric.

In step (i) of this aspect of this embodiment of the present invention there is no risk to the user of burns from a heated surface as with a conventional iron. If the ultrasonic source is active it will feel slippery, relative to when the ultrasonic source is inactive, to touch and therefore relatively easy to determine if the ultrasonic source is ready to use. These instructions are especially useful with a product comprising the ultrasonic de-wrinkling apparatus of the sixth aspect of the present invention.

Substances, such as water, salt, or ultrasonic transmission fluid can be applied directly to the ultrasonic source, for example, the plate of the ultrasonic de-wrinkling apparatus of the sixth aspect of the present invention to tell if the ultrasonic source is active. The ultrasonic source if turned on would make the water, salt etc., "dance" on the surface of the ultrasonic source and again making it easy for the consumer to detect if the apparatus was ready for use.

Alternatively, any ultrasonic source could be provided with light, for example, which would indicate that the ultrasonic source was ready for use.

The present invention also includes discrete fabric items, such as, for example clothing, linen and drapery, which has been smoothed and de-wrinkled according to the process of the present invention.

Ultrasonic Wave Source—A variety of ultrasonic sources can be used in the invention. It is preferred that the ultrasonic wave source be a transducer. Suitable transducers include, but are not limited to, magnetostrictive, piezoelectric, electromagnetic, capacitive, and electrostatic. One suitable piezoelectric material is Lead Zirconate Titanate available from APC International, Ltd. Run Mackeyville, Pa.

Typically, the ultrasonic wave source will have a power range of from about 25 watt to about 500 watts, more typically from about 30 watts to about 300 watts, of ultrasonic power is sufficient to treat garments and the like. A typical ultrasonic device for use herein will deliver from about 40 to about 300 watts of power.

Typical treatment times range from about 1 second to about 5 minutes, more typically from about 2 seconds to about 2 minutes, and most typically from about 3 seconds to 1 minute, although treatment times will vary with the severity of the wrinkle. The ultrasonic source device can be a vibrational ultrasonic generator, a torsional ultrasonic wave generator, or an axial ultrasonic generator in that it is the shock waves generated by these ultrasonic sources in conjunction with the ultrasonic transmission fluid that does the actual smoothing and de-wrinkling of the textile regardless of the mechanism by which the ultrasonic shock waves are generated.

The ultrasonic source typically oscillates at a frequency of from about 20 Hz to about 20,000 kHz, more preferably from about 100 Hz to about 10,000 kHz, more preferably from about 150 Hz to about 2000 kHz, more preferably from about 150 Hz to about 1,000 kHz, more preferably from about 150 Hz to about 100 kHz, more preferably from about 200 Hz to about 50 kHz. It is preferred that the average frequency be from about 1000 Hz to about 100 kHz, more preferably from about 10,000 Hz to about 70 kHz.

For the ultrasonic de-wrinkling apparatus the power source can be any conventional power source, such as mains power or plug-in type, rechargeable batteries, disposable batteries. The power source, especially when it is either rechargeable or disposable batteries, is optionally removable from the ultrasonic device.

The ultrasonic transmission fluid comprises an ultrasonic carrier and optionally, an ultrasonic adjuvant and these are exemplified in greater detail hereafter. The ultrasonic transmission fluid may be dispensed from the storage means automatically, or when desired by the device user. The ultrasonic transmission fluid may be dispensed from the storage means into the source of ultrasonic energy and applied by the source of ultrasonic energy directly to the surface concurrently with the ultrasonic energy. Alternatively, the ultrasonic transmission fluid may be dispensed on to the surface of the fabric that is not currently in contact with the source of ultrasonic energy. Such as in front of, to either side or behind the direction the source of ultrasonic energy is being moved over the fabric. It is preferred that ultrasonic transmission fluid is supplied to the surface coterminous with the source of ultrasonic energy. Furthermore, when the device does not contain storage means the ultrasonic transmission fluid can be either applied by the operator on to the fabric, the wrinkle in need of smoothing and de-wrinkling or directly on to the source of ultrasonic energy.

In one embodiment of the present invention the ultrasonic wave source is an ultrasonic de-wrinkling apparatus. The ultrasonic de-wrinkling apparatus comprises: a plate; ultrasonic means attached to the plate for generating ultrasonic waves in the plate; a housing attached to the plate having handle means for grasping the housing and moving the housing and the plate; and means to prevent the generation of heat in the plate by the moving of the plate on the fabric.

In one aspect of this embodiment of the present invention the ultrasonic de-wrinkling apparatus further comprises at least one solution storage means associated with the de-wrinkling apparatus. The solution storage means being adapted to contain an ultrasonic transmission fluid. And at least one dispensing means mounted in the housing. The dispensing means being in fluid communication with the storage means, and is adapted to dispense the ultrasonic transmission fluid from solution storage means to a fabric surface.

In a further aspect of this embodiment of the present invention the solution storage means is adapted to be removably mounted to the housing.

In a further aspect of this embodiment of the present invention the solution storage means is mounted in the housing.

The ultrasonic sources, like the de-wrinkling apparatus, according to the present invention can readily be applied to fabric article which contain buttons, zippers, plastic appliqués or the like. The ultrasonic sources, like the de-wrinkling apparatus, can run over buttons, zippers, plastic appliqués or the like without any impediment to the user or damage to the buttons, zippers, plastic appliqués or the like. This is unlike an iron where button and zippers prove to be a major impediment. Similarly, plastic appliqués are a major impediment, too hot an iron could mean at best a ruined garment and at worst an iron with melted plastic on the ironing plate.

Ultrasonic Transmission Fluid:

The ultrasonic transmission fluid comprises an ultrasonic carrier and optionally, an ultrasonic adjuvant. The ultrasonic transmission fluid is preferably essentially free of any material that would permanently soil or stain fabric under usage conditions.

It is preferred that the ultrasonic transmission fluid comprises at least about 85%, more preferably at least about 90%, even more preferably, at least about 95% even more preferably still, at least about 98% by weight of ultrasonic transmission fluid of ultrasonic carrier. The ultrasonic transmission fluid will also preferably contain no more than about 100%, more preferably no more than about 99.999%, even more preferably, no more than about 99.99%, even more preferably still, no more than about 99.98% by weight of ultrasonic transmission fluid of ultrasonic carrier.

It is preferred that the ultrasonic transmission fluid comprises at least about 0.001%, even more preferably, at least about 0.01% even more preferably still, at least about 0.02% by weight of ultrasonic transmission fluid of ultrasonic adjuvant. The ultrasonic transmission fluid will also preferably contain no more than about 15%, more preferably no more than about 10%, even more preferably, no more than about 5%, even more preferably still, no more than about 2% by weight of ultrasonic transmission fluid of ultrasonic adjuvant.

Ultrasonic Carrier:

The ultrasonic transmission fluid of the present invention may further comprise one or more ultrasonic carriers. Typically suitable ultrasonic carriers are solvents. Suitable solvents include those solvents that are polar, volatile, non-toxic, non-staining and non-greasy/oily. Solvents are broadly defined as compounds that are liquid at temperatures of 10° C.–35° C. and which are not considered to be surfactants. One of the distinguishing features is that solvents tend to exist as discrete entities rather than as broad mixtures of compounds. Examples of suitable solvents for the present invention include; water, methanol, ethanol, propanol, isopropanol, butoxy propoxy propanol, and mixtures thereof. Preferred among these solvents are water, ethanol, methanol, isopropanol, butoxy propoxy propanol and mixtures thereof.

An example of a suitable solvent that is polar, volatile, non-toxic, non-staining and non-greasy/oily is water. Water usable in the ultrasonic transmission fluid as the ultrasonic carrier can be distilled, deionized, or tap water.

It is preferred that the ultrasonic transmission fluid comprises at least about 85%, more preferably at least about 90%, even more preferably, at least about 95% even more preferably still, at least about 98% by weight of ultrasonic transmission fluid of ultrasonic carrier. The ultrasonic transmission fluid will also preferably contain no more than about 100%, more preferably no more than about 99.999%, even more preferably, no more than about 99.99%, even more preferably still, no more than about 99.98% by weight of ultrasonic transmission fluid of ultrasonic carrier.

The compositions used herein may optionally contain an alcohol having a hydrocarbon chain comprising 1 to 12 carbon atoms, preferably 1 to 6. The hydrocarbon chain can be branched or linear, and can be a mono, di or polyalcohols.

The solvents that can be used herein include all those known to those skilled in the art. Suitable solvents for use herein include ethers and diethers having from 4 to 14 carbon atoms, preferably from 6 to 12 carbon atoms, and more preferably from 8 to 10 carbon atoms. Also other suitable solvents are glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable glycols which can be used herein are according to the formula HO—CR1R2—OH wherein R1 and R2 are independently H or a C2–C10 saturated or unsaturated aliphatic hydrocarbon chain and/or cyclic. Suitable glycols to be used herein are dodecaneglycol and/or propanediol.

Suitable alkoxylated glycols which can be used herein are according to the formula R—$(A)_n$—R1—OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable diols have the formula R—C(OH)$R^1$—C(OH)$R^2$—$R^3$, wherein R, $R^1$, $R^2$ and $R^3$ are each independently selected from the group consisting of hydrogen, branched or linear, substituted or unsubstituted, $C_{1-12}$ alkyl, branched or linear, substituted or unsubstituted $C_{7-12}$ alkoxy, substituted or unsubstituted, $C_{6-12}$ aryl, branched or linear, substituted or unsubstituted $C_{7-12}$ alkylaryl. Preferably R, $R^1$, $R^2$ and $R^3$ are each independently selected from the group consisting of hydrogen and branched or linear, substituted or unsubstituted, $C_{2-12}$ alkyl, even more preferably R, $R^1$, $R^2$ and $R^3$ are selected such that the diol has a total of from 4 to 8, even more preferably still, 5 to 7, carbon atoms. Some suitable diols include, but are not limited to, hexane-1,4-diol, popane-1,3-diol, octane-1,4-diol and hexane-1,3-diol.

Suitable alkoxylated aromatic alcohols which can be used herein are according to the formula R$(A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols that can be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols that can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula R$(A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear C1–C5 alcohols which can be used herein are according to the formula R$(A)_n$—OH wherein R is a linear saturated or unsaturated alkyl group of from 1 to 5 carbon atoms, preferably from 2 to 4, wherein A is an alkoxy group preferably butoxy, propoxy and/or ethoxy, and n is an integer of from 1 to 5, preferably 1 to 2. Suitable alkoxylated aliphatic linear C1–C5 alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical. Also suitable are mixtures of branched and linear alkoxylated alcohols. One suitable mixture of branched and linear alkoxylated alcohols is Aquasolve® available from Firmenich. Aquasolve® is a mixture comprising $CH_3CH_2OCH_2CH_2OCH_2CH_2OH$, $CH_3OCH_2CH(CH_3)OCH_2CH(CH_3)OH$, $CH_3CH(OH)CH_2OCH_2CH(CH_3)OCH_3$, and $CH_3CH_2OH$.

Suitable linear C1–C5 alcohols that can be used herein are according to the formula R—OH wherein R is a linear saturated or unsaturated alkyl group of from 1 to 5 carbon atoms, preferably from 2 to 4. Suitable linear C1–C5 alcohols are methanol, ethanol, propanol or mixtures thereof.

Other suitable solvents include, but are not limited to, butyl diglycol ether (BDGE), butyltriglycol ether, ter amilic alcohol and the like. Particularly preferred solvents that can be used herein are butoxy propoxy propanol, butyl diglycol ether, benzyl alcohol, butoxypropanol, ethanol, methanol, isopropanol and mixtures thereof.

Other suitable solvents for use herein include propylene glycol derivatives such as n-butoxypropanol or n-butoxypropoxypropanol, water-soluble CARBITOL® solvents or water-soluble CELLOSOLVE® solvents; water-soluble CARBITOL® solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE® solvents are compounds of the 2-alkoxyethoxy ethanol class, with 2-butoxyethoxyethanol being preferred. Other suitable solvents include benzyl alcohol, and diols such as 2-ethyl-1,3-hexanediol and 2,2,4-trimethyl-1,3-pentanediol and mixtures thereof. Some preferred solvents for use herein are n-butoxypropoxypropanol, BUTYL CARBITOL® and mixtures thereof.

The solvents can also be selected from the group of compounds comprising ether derivatives of mono-, di- and tri-ethylene glycol, propylene glycol, butylene glycol ethers, and mixtures thereof. The molecular weights of these solvents are preferably less than 350, more preferably between 100 and 300, even more preferably between 115 and 250. Examples of preferred solvents include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the trade name "Dowanol" and from the Arco Chemical Company under the trade name "Arcosolv". Other preferred solvents including mono- and di-ethylene glycol n-hexyl ether are available from the Union Carbide Company.

Low molecular weight polyols with relatively high boiling points, as compared to water, such as ethylene glycol, diethylene glycol, triethylene glycol, propylene glycol, dipropylene glycol, and/or glycerine are preferably present as all or part of the ultrasonic carrier when the optional adjuvant, cyclodextrin an ingredient for improving odor control performance of the ultrasonic transmission fluid, is present. Not to be bound by theory, it is believed that the incorporation of a small amount of low molecular weight glycols into the ultrasonic transmission fluid when cyclodextrin is present enhances the formation of the cyclodextrin inclusion complexes as the fabric dries.

It is believed that the polyols' ability to remain on the fabric for a longer period of time than water, as the fabric dries allows it to form ternary complexes with the cyclodextrin and some malodorous molecules. The addition of the glycols is believed to fill up void space in the cyclodextrin cavity that is unable to be totally filled by some malodor molecules of relatively smaller sizes. Preferably the glycol used is glycerine, ethylene glycol, propylene glycol, dipropylene glycol or mixtures thereof, more preferably ethylene glycol and propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the composition of the present invention.

The preferred weight ratio of low molecular weight polyol to cyclodextrin is from about 2:1,000 to about 20:100, more preferably from about 3:1,000 to about 15:100, even more preferably from about 5:1,000 to about 10:100, and most preferably from about 1:100 to about 7:100.

Ultrasonic Adjuvant:

The ultrasonic transmission fluid may optionally comprise and ultrasonic adjuvant. These adjuvants are for assisting or enhancing smoothing and de-wrinkling performance, treatment of the substrate to be smoothed and de-wrinkled, or to modify the aesthetics of the ultrasonic transmission fluid (e.g., perfumes, colorants, dyes, etc.).

The ultrasonic transmission fluid may comprise at least about 0%, more preferably at least about 0.001%, even more preferably, at least about 0.01% even more preferably still, at least about 0.02% by weight of ultrasonic transmission fluid of ultrasonic adjuvant. The ultrasonic transmission fluid will also preferably contain no more than about 15%, more preferably no more than about 10%, even more preferably, no more than about 5%, even more preferably still, no more than about 2% by weight of ultrasonic transmission fluid of ultrasonic adjuvant.

The adjuvants will be non-staining and non-greasy/oily. That is, leaving no noticeable residue on the fabric, after application of ultrasonic energy, which could stain or disfigure the fabric. For example, a perfume can be deposited on the fabric with the intention that it remain thereon, the perfume will not leave any noticeable residue, after ultrasonic energy has been applied, which will detract from the appearance of the garment. Likewise, other suitable adjuvants, such as, photobleaches, odor control agents, optical brighteners, anti-microbial agents, fabric softening agents, finishing aids, etc. will not leave any noticeable residue which will detract from the appearance of the garment.

Some suitable ultrasonic adjuvants include of, wetting agents, alkalinity sources, antibacterial agent, colorants, perfume, preservatives, photobleaches, heavy metal ion sequestrants, finishing aids, anti-tarnishing agents, anti-microbial agents, chelants, insect and moth repelling agents, anti-oxidants, polymeric agents, electrolytes, odor control agent, pH modifiers, divalent ions, metal ion salts, corrosion process aids, fabric softening agents, optical brighteners, hydrotropes and mixtures thereof. The following are illustrative examples of such adjunct materials.

Wetting Agents

Wetting agents may be included in the compositions of the present invention as an ultrasonic adjuvant. It is preferred that the ultrasonic transmission fluid comprises at least about 0%, more preferably at least about 0.001%, even more preferably, at least about 0.01% even more preferably still, at least about 0.02% by weight of ultrasonic transmission fluid of wetting agents. The ultrasonic transmission fluid will also preferably contain no more than about 15%, more preferably no more than about 10%, even more preferably, no more than about 5%, even more preferably still, no more than about 2% by weight of ultrasonic transmission fluid of wetting agents.

Suitable wetting agents include, anionic surfactants, nonionic surfactants, cationic surfactants, amphoteric surfactants, zwitterionic surfactants and mixtures thereof. Examples of suitable surfactants can be found in McCutcheon's EMULSIFIERS AND DETERGENTS, North American Edition, 1997, McCutcheon Division, MC Publishing Company, in U.S. Pat. No. 3,929,678, Dec. 30, 1975 Laughlin, et al, and U.S. Pat. No. 4,259,217, Mar. 31, 1981, Murphy; in the series "Surfactant Science", Marcel Dekker, Inc., New York and Basel; in "Handbook of Surfactants", M. R. Porter, Chapman and Hall, 2nd Ed., 1994; in "Surfactants in Consumer Products", Ed. J. Falbe, Springer-Verlag, 1987 and "Surface Active Agents and Detergents" (Vol. I and II by Schwartz, Perry and Berch) all of which are incorporated hereinbefore by reference.

Nonlimiting examples of surfactants useful as wetting agents herein include the conventional C11–C18 alkyl benzene sulfonates and primary, secondary and random alkyl sulfates, the C10–C18 alkyl alkoxy sulfates, the C10–C18 alkyl polyglycosides and their corresponding sulfated polyglycosides, C12–C18 alpha-sulfonated fatty acid esters, C12–C18 alkyl and alkyl phenol alkoxylates (especially ethoxylates and mixed ethoxy/propoxy), C12–C18 betaines and sulfobetaines ("sultaines"), C10–C18 amine oxides, $C_6$ to $C_{18}$ branched or linear alkyl sulfates, $C_6$ to $C_{18}$ branched or linear alkyl benzene sulfonates, $C_6$ to $C_{18}$ branched or linear alkyl alkoxy sulfates, $C_6$ to $C_{18}$ branched or linear alkyl carboxylates, and mixtures thereof. Other conventional useful surfactants are listed in standard texts.

Anionic Surfactants

The anionic surfactants useful in the present invention are preferably selected from the group consisting of, linear alkylbenzene sulfonate, alpha olefin sulfonate, paraffin sulfonates, alkyl ester sulfonates, alkyl sulfates, alkyl alkoxy sulfate, alkyl sulfonates, alkyl alkoxy carboxylate, alkyl alkoxylated sulfates, sarcosinates, taurinates, and mixtures thereof, more preferably $C_6$ to $C_{18}$ branched or linear alkyl sulfates, $C_6$ to $C_{18}$ branched or linear alkyl benzene sulfonates, $C_6$ to $C_{18}$ branched or linear alkyl alkoxy sulfates, and mixtures thereof.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$–$C_{24}$ hydrocarbyl, more preferably an alkyl or hydroxyalkyl having a $C_{10}$–$C_{20}$ alkyl component, even more preferably a $C_{12}$–$C_{18}$ alkyl or hydroxyalkyl, and M is H or a cation, e.g., an alkali (Group IA) metal cation (e.g., sodium, potassium, lithium), substituted or unsubstituted ammonium cations such as methyl-, dimethyl-, and trimethyl ammonium and quatemary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl alkoxylated sulfate surfactants are another category of useful anionic surfactant. These surfactants are water soluble salts or acids typically of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines, e.g. monoethanolamine, diethanolamine, and triethanolamine, and mixtures thereof. Exemplary surfactants are $C_{12}$–$C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium. Surfactants for use herein can be made from natural or synthetic alcohol feedstocks. Chain lengths represent average hydrocarbon distributions, including branching.

One example of cyclodextrin-compatible anionic surfactants that are the alkyldiphenyl oxide disulfonate, having the general formula:

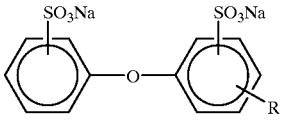

wherein R is an alkyl group. Examples of this type of surfactants are available from the Dow Chemical Company under the trade name Dowfax® wherein R is a linear or branched $C_6$–$C_{16}$ alkyl group. An example of these cyclodextrin-compatible anionic surfactant is Dowfax 3B2 with R being approximately a linear $C_{10}$ group. These anionic surfactants are preferably not used when the antimicrobial active or preservative, etc., is cationic to minimize the interaction with the cationic actives, since the effect of both surfactant and active are diminished.

Examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Nonionic Surfactants—One suitable type of surfactants for use as wetting agents in ultrasonic transmission fluid are nonionic surfactants. Suitable nonionic surfactants include C12–C18 alkyl alkoxylates (especially when the alkoxy group is ethoxy and mixed ethoxy/propoxy).

Useful in the present invention are the mixed nonionic surfactants. While a wide range of nonionic surfactants may be selected from for purposes of the mixed nonionic surfactant systems useful in the present invention compositions, it is possible that the nonionic surfactants comprise a mixture of nonionic surfactants.

Some nonionic surfactants suitable for use as wetting agents include nonionic alkoxylated surfactants; especially ethoxylates derived from primary alcohol, and polyoxypropylene/polyoxyethylene/polyoxypropylene (PO/EO/PO) reverse block polymers. Also, ethoxylated-propoxylated alcohol (e.g., Olin Corporation's Poly-Tergent® SLF18) and epoxy-capped poly(oxyalkylated) alcohols (e.g., Olin Corporation's Poly-Tergent® SLF18B series of nonionics, as described, for example, in WO 94/22800, published Oct. 13, 1994 by Olin Corporation). These nonionic surfactants can optionally contain propylene oxide in an amount up to about 15% by weight. Other preferred nonionic surfactants can be prepared by the processes described in U.S. Pat. No. 4,223,163, issued Sep. 16, 1980, Builloty, incorporated herein by reference.

Further suitable nonionic surfactants include the polyoxyethylene, polyoxypropylene block polymeric compounds. Block polyoxyethylene-polyoxypropylene polymeric compounds include those based on ethylene glycol, propylene glycol, glycerol, trimethylolpropane and ethylenediamine as initiator reactive hydrogen compound. Certain of the block polymer surfactant compounds designated PLURONIC®, REVERSED PLURONIC®, and TETRONIC® by the BASF-Wyandotte Corp., Wyandotte, Mich., are suitable in ADD compositions of the invention. Preferred examples include REVERSED PLURONIC® 25R2 and TETRONIC® 702, such surfactants are typically useful herein as wetting agents.

Another type of nonionic surfactant system suitable for use as a wetting agent included ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis. Such nonionic surfactants include, for example, Tergitol 15S9 (supplied by Union Carbide), Rhodasurf TMD 8.5 (supplied by Rhone Poulenc), and Neodol 91-8 (supplied by Shell).

Another suitable nonionic surfactant is derived from a straight or preferably branched chain or secondary fatty alcohol containing from about 6 to about 20 carbon atoms (C6–C20 alcohol), including secondary alcohols and branched chain primary alcohols. Preferably, these nonionic surfactants are branched or secondary alcohol ethoxylates, more preferably mixed C9/11 or C11/15 branched alcohol ethoxylates, condensed with an average of from about 6 to about 15 moles, preferably from about 6 to about 12 moles, and most preferably from about 6 to about 9 moles of ethylene oxide per mole of alcohol. The ethoxylated nonionic surfactant can be so derived to have a narrow ethoxylate distribution relative to the average.

Another suitable type of nonionic surfactants for use as wetting agents type is the endcapped alkyl alkoxylate surfactants. Suitable endcapped alkyl alkoxylate surfactants are the epoxy-capped poly(oxyalkylated) alcohols represented by the formula:

$$R_1O[CH_2CH(CH_3)O]_x[CH_2CH_2O]_y[CH_2CH(OH)R_2] \quad (I)$$

wherein $R_1$ is a linear or branched, aliphatic hydrocarbon radical having from about 4 to about 18 carbon atoms; $R_2$ is a linear or branched aliphatic hydrocarbon radical having from about 2 to about 26 carbon atoms; x is an integer having an average value of from about 0.5 to about 1.5, more preferably about 1; and y is an integer having a value of at least 15, more preferably at least 20.

Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Another suitable ether-capped poly(oxyalkylated) alcohols has the formula:

$$R^1O[CH_2CH(R^3)O]_x[CH_2]_kCH(OH)[CH_2]_jOR^2$$

wherein $R^1$ and $R^2$ are linear or branched, saturated or unsaturated, aliphatic or aromatic hydrocarbon radicals having from 1 to 30 carbon atoms; $R^3$ is H, or a linear aliphatic hydrocarbon radical having from 1 to 4 carbon atoms; x is an integer having an average value from 1 to 30, wherein when x is 2 or greater $R^3$ may be the same or different and k and j are integers having an average value of from 1 to 12, and more preferably 1 to 5.

Another suitable class of nonionic surfactants comprises sugar-derived surfactants such as the polyhydroxy fatty acid amides of the formula:

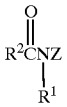

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2—(CHOH)_4—CH_2OH$.

R' can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

One suitable alkylpolyglycosides has the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Nonlimiting examples of nonionic surfactants, which are compatible with cyclodextrin, include block copolymers of ethylene oxide and propylene oxide. Suitable block polyoxyethylene-polyoxypropylene polymeric surfactants, that are compatible with most cyclodextrins, include those based on ethylene glycol, propylene glycol, glycerol, trimethylolpropane and ethylenediamine as the initial reactive hydrogen compound. Polymeric compounds made from a sequential ethoxylation and propoxylation of initial compounds with a single reactive hydrogen atom, such as $C_{12-18}$ aliphatic alcohols, are not generally compatible with the cyclodextrin. Certain of the block polymer surfactant compounds designated Pluronic® and Tetronic® by the BASF-Wyandotte Corp., Wyandotte, Mich., are readily available.

Nonlimiting examples of cyclodextrin-compatible surfactants of this type include:

Pluronic Surfactants with the general formula $H(EO)_n(PO)_m(EO)_nH$, wherein EO is an ethylene oxide group, PO is a propylene oxide group, and n and m are numbers that indicate the average number of the groups in the surfactants. Typical examples of cyclodextrin-compatible Pluronic surfactants are:

| Name | Average MW | Average n | Average m |
|---|---|---|---|
| L-101 | 3,800 | 4 | 59 |
| L-81 | 2,750 | 3 | 42 |
| L-44 | 2,200 | 10 | 23 |
| L-43 | 1,850 | 6 | 22 |

-continued

| Name | Average MW | Average n | Average m |
|---|---|---|---|
| F-38 | 4,700 | 43 | 16 |
| P-84 | 4,200 | 19 | 43, |

and mixtures thereof.

Tetronic Surfactants with the general formula:

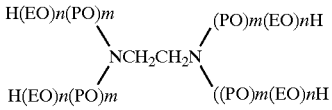

wherein EO, PO, n, and m have the same meanings as above. Typical examples of cyclodextrin-compatible Tetronic surfactants are:

| Name | Average MW | Average n | Average m |
|---|---|---|---|
| 901 | 4,700 | 3 | 18 |
| 908 | 25,000 | 114 | 22, |

and mixtures thereof.

"Reverse" Pluronic and Tetronic surfactants have the following general formulas:

Reverse Pluronic Surfactants $H(PO)_m(EO)_n(PO)_mH$

Reverse Tetronic Surfactants

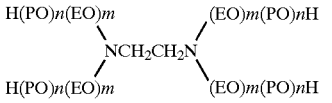

wherein EO, PO, n, and m have the same meanings as above. Typical examples of cyclodextrin-compatible Reverse Pluronic and Reverse Tetronic surfactants are:

| Name | Average MW | Average n | Average m |
|---|---|---|---|
| | Reverse Pluronic surfactants: | | |
| 10 R5 | 1,950 | 8 | 22 |
| 25 R1 | 2,700 | 21 | 6 |
| | Reverse Tetronic surfactants | | |
| 130 R2 | 7,740 | 9 | 26 |
| 70 R2 | 3,870 | 4 | 13 |

and mixtures thereof.

One type class of nonionic surfactants, which are cyclodextrin-compatible, is the polyalkyleneoxide polysiloxanes having a dimethyl polysiloxane hydrophobic moiety and one or more hydrophilic polyalkylene side chains and has the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxide/propyleneoxide) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group.

Examples of this type of surfactants are the Silwet® surfactants that are available CK Witco, OSi Division, Danbury, Conn. Representative Silwet surfactants are as follows.

| Name | Average MW | Average a + b | Average total c |
|---|---|---|---|
| L-7608 | 600 | 1 | 9 |
| L-7607 | 1,000 | 2 | 17 |
| L-77 | 600 | 1 | 9 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers that provide molecular weights within these ranges. However, the number of ethyleneoxy units ($—C_2H_4O$) in the polyether chain ($R^1$) must be sufficient to render the polyalkyleneoxide polysiloxane water dispersible or water soluble. If propyleneoxy groups are present in the polyalkylenoxy chain, they can be distributed randomly in the chain or exist as blocks. Preferred Silwet surfactants are L-7600, L-7602, L-7604, L-7605, L-7657, and mixtures thereof. Besides surface activity, polyalkyleneoxide polysiloxane surfactants can also provide other benefits, such as antistatic benefits, and softness to fabrics.

The preparation of polyalkyleneoxide polysiloxanes is well known in the art. Polyalkyleneoxide polysiloxanes of the present invention can be prepared according to the procedure set forth in U.S. Pat. No. 3,299,112, which is incorporated herein by reference. Typically, polyalkyleneoxide polysiloxanes of the surfactant blend of the present invention are readily prepared by an addition reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well known in the art and in general involve heating the reactants (e.g., at a temperature of from about 85° C. to 110° C.) in the presence of a platinum catalyst (e.g., chloroplatinic acid) and a solvent (e.g., toluene).

These and other nonionic surfactants suitable for use as wetting agents are well known in the art, being described in more detail in Kirk Othmer's Encyclopedia of Chemical Technology, 3rd Ed., Vol. 22, pp. 360–379, "Surfactants and Detersive Systems", incorporated by reference herein. Further suitable nonionic detergent surfactants are generally disclosed in U.S. Pat. No. 3,929,678, Laughlin et al., issued Dec. 30, 1975, at column 13, line 14 through column 16, line 6, incorporated herein by reference.

Cationic Surfactants Cationic surfactants suitable for use as wetting agents in the compositions of the present invention include those having a long-chain hydrocarbyl group. Cationic surfactant have the additional benefits in that they may also be selected for their biocidal and/or fabric softening properties. Examples of suitable cationic surfactants include the ammonium surfactants such as alkyldimethylammonium halogenides, and those co-surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof, each $R^4$ is selected from the group consisting of $C_1$–$C_4$ alkyl, $C_1$–$C_4$ hydroxyalkyl, benzyl ring structures formed by joining the two $R^4$ groups, $—CH_2CHOH\text{-}CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Examples of other suitable cationic surfactants are described in following documents, all of which are incorporated by reference herein in their entirety: M.C. Publishing Co., McCutcheon's, Detergents & Emulsifiers, (North American edition 1997); Schwartz, et al., Surface Active Agents, Their Chemistry and Technology, New York: Interscience Publishers, 1949; U.S. Pat. No. 3,155,591; U.S. Pat. No. 3,929,678; U.S. Pat. No. 3,959,461 U.S. Pat. No. 4,387,090 and U.S. Pat. No. 4,228,044.

Examples of cationic surfactants suitable as wetting agents are those corresponding to the general formula:

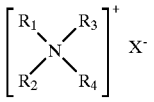

wherein $R_1$, $R_2$, $R_3$, and $R_4$ are independently selected from an aliphatic group of from 1 to about 22 carbon atoms or an aromatic, alkoxy, polyoxyalkylene, alkylamido, hydroxyalkyl, aryl or alkylaryl group having up to about 22 carbon atoms; and X is a salt-forming anion such as those selected from halogen, (e.g. chloride, bromide), acetate, citrate, lactate, glycolate, phosphate nitrate, sulfate, and alkylsulfate radicals. The aliphatic groups can contain, in addition to carbon and hydrogen atoms, ether linkages, and other groups such as amino groups. The longer chain aliphatic groups, e.g., those of about 12 carbons, or higher, can be saturated or unsaturated. Preferred is when $R_1$, $R_2$, $R_3$, and $R_4$ are independently selected from C1 to about C22 alkyl. Especially preferred are cationic materials containing two long alkyl chains and two short alkyl chains or those containing one long alkyl chain and three short alkyl chains. The long alkyl chains in the compounds described in the previous sentence have from about 12 to about 22 carbon atoms, preferably from about 16 to about 22 carbon atoms, and the short alkyl chains in the compounds described in the previous sentence have from I to about 3 carbon atoms, preferably from 1 to about 2 carbon atoms.

Other Surfactants Amphoteric or zwitterionic detersive surfactants are suitable for use as wetting agents in the present invention.

Suitable amphoteric surfactants include the amine oxides corresponding to the formula:

$$RR'R''N\rightarrow O$$

wherein R is a primary alkyl group containing 6–24 carbons, preferably 10–18 carbons, and wherein R' and R" are, each, independently, an alkyl group containing 1 to 6 carbon atoms. The arrow in the formula is a conventional representation of a semi-polar bond.

Amine oxides are semi-polar surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Some preferred amine oxide surfactants include those of the formula $$R^3(OR^4)_xN(\overset{O}{\overset{|}{}}R^5)_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof, x is from 0 to about 3; and each $R^5$ is an alkyl or hydroxyalkyl group containing from about 1 to about 3 carbon atoms or a polyethylene oxide group containing from about 1 to about 3 ethylene oxide groups. The R5 groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Some suitable zwitterionic surfactants which can be used herein comprise the betaine and betaine-like surfactants wherein the molecule contains both basic and acidic groups which form an inner salt giving the molecule both cationic and anionic hydrophilic groups over a broad range of pH values. Some common examples of these are described in U.S. Pat. Nos. 2,082,275, 2,702,279 and 2,255,082, all of which are incorporated herein by reference. One suitable zwitterionic compound has the formula $$R^1—\overset{R^2}{\underset{R^3}{N}}—CH_2—\underset{X}{R^4}—Y^-$$

wherein R1 is an alkyl radical containing from 8 to 22 carbon atoms, R2 and R3 contain from 1 to 3 carbon atoms, R4 is an alkylene chain containing from 1 to 3 carbon atoms, X is selected from the group consisting of hydrogen and a hydroxyl radical, Y is selected from the group consisting of carboxyl and sulfonyl radicals and wherein the sum of R1, R2 and R3 radicals is from 14 to 24 carbon atoms.

Zwitterionic surfactants, as mentioned hereinbefore, contain both a cationic group and an anionic group and are in substantial electrical neutrality where the number of anionic charges and cationic charges on the surfactant molecule are substantially the same.

Finishing Aids The ultrasonic transmission fluids according to the present invention may optionally contain a finishing aid. Suitable finishing aids includes, but are not limited to, cellulosic polymers, such as, carboxymethyl cellulose, hydroxypropyl methyl cellulose; or finishing polymers; such as synthetic, such as poly acrylates, or natural, such as, starch.

These polymers can be natural, or synthetic, and can act by forming a film, and/or by providing adhesive properties. E.g., the present invention can optionally use film-forming and/or adhesive polymer to impart shape retention to fabric, particularly clothing. By "adhesive" it is meant that when applied as a solution or dispersion to a fiber surface and dried, the polymer can attach to the surface. The polymer can form a film on the surface, or when residing between two fibers and in contact with the two fibers, it can bond the two fibers together. Other polymers such as starches can form a film and/or bond the fibers together when a hot iron presses the treated fabric. Such a film will have adhesive strength, cohesive breaking strength, and cohesive breaking strain.

The polymer useful in providing shape retention in the composition of the present invention should be cyclodextrin-compatible that is it should not substantially form complex with cyclodextrin so as to diminish performance of the cyclodextrin and/or the polymer. Complex formation affects both the ability of the cyclodextrin to absorb odors and the ability of the polymer to impart shape retention to fabric.

Nonlimiting examples for natural polymers are starches and their derivatives, and chitins and their derivatives.

The synthetic polymers useful in the present invention are comprised of monomers. Some nonlimiting examples of monomers which can be used to form the synthetic polymers of the present invention include: low molecular weight $C_1$–$C_6$ unsaturated organic mono- and polycarboxylic acids, such as acrylic acid, methacrylic acid, crotonic acid, maleic acid and its half esters, itaconic acid, and mixtures thereof; esters of said acids with $C_1$–$C_6$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, and the like, and mixtures thereof. Nonlimiting examples of said esters are methyl acrylate, ethyl acrylate, t-butyl acrylate, methyl methacrylate, hydroxyethyl methacrylate, methoxy ethyl methacrylate, and mixtures thereof; amides and imides of said acids, such as N,N-dimethylacrylamide, N-t-butyl acrylamide, maleimides; low molecular weight unsaturated alcohols such as vinyl alcohol (produced by the hydrolysis of vinyl acetate after polymerization), allyl alcohol; esters of said alcohols with low molecular weight carboxylic acids, such as, vinyl acetate, vinyl propionate; ethers of said alcohols such as methyl vinyl ether; polar vinyl heterocyclics, such as vinyl pyrrolidone, vinyl caprolactam, vinyl pyridine, vinyl imidazole, and mixtures thereof; other unsaturated amines and amides, such as vinyl amine, diethylene triamine, dimethylaminoethyl methacrylate, ethenyl formamide; vinyl sulfonate; salts of acids and amines listed above; low molecular weight unsaturated hydrocarbons and derivatives such as ethylene, propylene, butadiene, cyclohexadiene, vinyl chloride; vinylidene chloride; and mixtures thereof and alkyl quaternized derivatives thereof, and mixtures thereof. Preferably, said monomers are selected from the group consisting of vinyl alcohol; acrylic acid; methacrylic acid; methyl acrylate; ethyl acrylate; methyl methacrylate; t-butyl acrylate; t-butyl methacrylate; n-butyl acrylate; n-butyl methacrylate; dimethylaminoethyl methacrylate; N,N-dimethyl acrylamide; N,N-dimethyl methacrylamide; N-t-butyl acrylamide; vinylpyrrolidone; vinyl pyridine; adipic acid; diethylenetriamine; salts thereof and alkyl quaternized derivatives thereof, and mixtures thereof. Monomers that provide pendant groups that can complex with cyclodextrin are not preferred because they can form complex with cyclodextrin. Examples of such monomers are acrylic or methacrylic acid esters of $C_7$–$C_{18}$ alcohols, such as neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, and 1-decanol; styrene; t-butylstyrene; vinyl toluene; and the like.

Preferably, said monomers form homopolymers and/or copolymers (i.e., the film-forming and/or adhesive polymer) having a glass transition temperature (Tg) of from about −20° C. to about 150° C., preferably from about −10° C. to about 150° C., more preferably from about 0° C. to about 100° C., most preferably, the adhesive polymer hereof, when dried to form a film will have a Tg of at least about 25° C., so that they are not unduly sticky, or "tacky" to the touch. Preferably said polymer is soluble and/or dispersible in water and/or alcohol. Said polymer typically has a molecular weight of at least about 500, preferably from about 1,000 to about 2,000,000, more preferably from about 5,000 to about 1,000,000, and even more preferably from about 30,000 to about 300,000 for some polymers.

Some non-limiting examples of homopolymers and copolymers which can be used as film-forming and/or adhesive polymers of the present invention are: adipic acid/dimethylaminohydroxypropyl diethylenetriamine copolymer; adipic acid/epoxypropyl diethylenetriamine copolymer; poly(vinylpyrrolidone/dimethylaminoethyl methacrylate); polyvinyl alcohol; polyvinylpyridine n-oxide; methacryloyl ethyl betaine/methacrylates copolymer; ethyl acrylate/methyl methacrylate/methacrylic acid/acrylic acid copolymer; polyamine resins; and polyquatemary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride). Preferably, said copolymer and/or homopolymers are selected from the group consisting of adipic acid/dimethylaminohydroxypropyl diethylenetriamine copolymer; poly(vinylpyrrolidone/dimethylaminoethyl methacrylate); polyvinyl alcohol; ethyl acrylate/methyl methacrylate/methacrylic acid/acrylic acid copolymer; methacryloyl ethyl betaine/methacrylates copolymer; polyquatemary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride).

Nonlimiting examples of the preferred polymer that are commercially available are: polyvinylpyrrolidone/dimethylaminoethyl methacrylate copolymer, such as Copolymer 958®, molecular weight of about 100,000 and Copolymer 937, molecular weight of about 1,000,000, available from GAF Chemicals Corporation; adipic acid/dimethylaminohydroxypropyl diethylenetriamine copolymer, such as Cartaretin F-4® and F-23, available from Sandoz Chemicals Corporation; methacryloyl ethyl betaine/methacrylates copolymer, such as Diaformer Z-SM®, available from Mitsubishi Chemicals Corporation; polyvinyl alcohol copolymer resin, such as Vinex $_{2019}$®, available from Air Products and Chemicals or Moweol®, available from Clariant; adipic acid/epoxypropyl diethylenetriamine copolymer, such as Delsette 101®, available from Hercules Incorporated; polyamine resins, such as Cypro 515®, available from Cytec Industries; polyquaternary amine resins, such as Kymene $_{557}$H®, available from Hercules Incorporated; and polyvinylpyrrolidone/acrylic acid, such as Sokalan EG 310®, available from BASF.

Preferred polymers useful in the present invention are selected from the group consisting of copolymers of hydrophilic monomers and hydrophobic monomers. The polymer can be linear random or block copolymers, and mixtures thereof. Such hydrophobic/hydrophilic copolymers typically have a hydrophobic monomer/hydrophilic monomer ratio of from about 95:5 to about 20:80, preferably from about 90:10 to about 40:60, more preferably from about 80:20 to about 50:50 by weight of the copolymer. The hydrophobic monomer can comprise a single hydrophobic monomer or a mixture of hydrophobic monomers, and the hydrophilic monomer can comprise a single hydrophilic monomer or a mixture of hydrophilic monomers. The term "hydrophobic" is used herein consistent with its standard meaning of lacking affinity for water, whereas "hydrophilic" is used herein consistent with its standard meaning of having affinity for water. As used herein in relation to monomer units and polymeric materials, including the copolymers, "hydrophobic" means substantially water insoluble; "hydrophilic" means substantially water-soluble. In this regard, "substantially water insoluble" shall refer to a material that is not soluble in distilled (or equivalent) water, at 25° C., at a concentration of about 0.2% by weight, and preferably not soluble at about 0.1% by weight (calculated on a water plus monomer or polymer weight basis). "Substantially water soluble" shall refer to a material that is soluble in distilled (or equivalent) water, at 25° C., at a concentration of about 0.2% by weight, and are preferably soluble at about 1% by weight. The terms "soluble", "solubility" and the like, for purposes hereof, corresponds to the maximum concentration of monomer or polymer, as applicable, that can dissolve in water or other solvents to form a homogeneous solution, as is well understood to those skilled in the art.

Nonlimiting examples of useful hydrophobic monomers are acrylic acid $C_1$–$C_6$ alkyl esters, such as methyl acrylate, ethyl acrylate, t-butyl acrylate; methacrylic $C_1$–$C_6$ alkyl esters, such as methyl methacrylate, methoxy ethyl methacrylate; vinyl alcohol esters of carboxylic acids, such as, vinyl acetate, vinyl propionate, vinyl ethers, such as methyl vinyl ether; vinyl chloride; vinylidene chloride; ethylene, propylene and other unsaturated hydrocarbons; and the like; and mixtures thereof. Some preferred hydrophobic monomers are methyl acrylate, methyl methacrylate, t-butyl acrylate, t-butyl methacrylate, n-butyl acrylate, n-butyl methacrylate, and mixtures thereof.

Nonlimiting examples of useful hydrophilic monomers are unsaturated organic mono- and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as vinyl pyrrolidone, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, vinyl pyrrolidone, salts thereof and alkyl quaternized derivatives thereof, and mixtures thereof.

Non limiting examples of polymers for use in the present invention include the following, where the composition of the copolymer is given as approximate weight percentage of each monomer used in the polymerization reaction used to prepare the polymer: vinyl pyrrolidone/vinyl acetate copolymers (at ratios of up to about 30% by weight of vinyl pyrrolidone); vinyl pyrrolidone/vinyl acetate/butyl acrylate copolymer (10/78/12 and 10/70/20); vinyl pyrrolidone/vinyl propionate copolymer (5/95); vinyl caprolactam/vinyl acetate copolymer (5/95); and resins sold under the trade names Ultrahold CA 8® by Ciba Geigy (ethyl acrylate/acrylic acid/N-t-butyl acrylamide copolymer); Resyn 28–1310® by National Starch and Luviset CA 66® by BASF (vinyl acetate/crotonic acid copolymer 90/10); Luviset CAP® by BASF (vinyl acetate/vinyl propionate/crotonic acid 50/40/10); Amerhold DR-25® by Union Carbide (ethyl acrylate/methacrylic acid/methyl methacrylate/acrylic acid copolymer), and Poligen A® by BASF (polyacrylate dispersion). One highly preferred polymer is composed of acrylic acid and t-butyl acrylate monomeric units, preferably with acrylic acid/t-butyl acrylate ratio of from about 90:10 to about 10:90, preferably from about 70:30 to about 15:85, more preferably from about 50:50 to about 20:80, by weight of the polymer. Nonlimiting examples of acrylic acid/tert-butyl acrylate copolymers useful in the present invention are those with an approximate acrylic acid/tert-butyl acrylate weight ratio of about 25:75 and an average molecular weight of from about 70,000 to about 100,000, and those with an approximate acrylic acid/tert-butyl acrylate weight ratio of about 35:65 and an average molecular weight of from about 60,000 to about 90,000.

The film-forming and/or adhesive polymer of the present invention is present at least an effective amount to provide shape retention, typically from about 0.05% to about 5%, preferably from about 0.1% to about 3%, more preferably from about 0.2% to about 2%, even more preferably from about 0.3% to about 1%, by weight of the usage composition.

It is not intended to exclude the use of higher or lower levels of the polymers, as long as an effective amount is used to provide adhesive and film-forming properties to the composition and the composition can be formulated and effectively applied for its intended purpose.

Silicones and film-forming polymers can be combined to produce preferred wrinkle reducing actives. Typically the weight ratio of silicone to film-forming polymer is from about 10:1 to about 1:10, preferably from about 5:1 to about 1:5, and more preferably from about 2:1 to about 1:2. Typically, the preferred wrinkle reducing active of silicone plus polymer is present at a level of from about 0.1% to about 8%, preferably from about 0.3% to about 5%, more preferably from about 0.5% to about 3%, by weight of the composition.

Other preferred adhesive and/or film forming polymers that are useful in the composition of the present invention actually contain silicone moieties in the polymers themselves, typically present as block and/or graft copolymers.

The preferred polymers for use herein have the characteristic of providing a natural appearing "drape" in which the fabric does not form wrinkles, or resist deformation.

Starch is not normally preferred, since it makes the fabric resistant to deformation. However, it does provide increased "body" which is often desired. Starch is particularly preferred in compositions of this invention to be used with ironing. When used, starch is solubilized or dispersed in the composition. Any type of starch, e.g. those derived from corn, wheat, rice, grain sorghum, waxy grain sorghum, waxy maize or tapioca, or mixtures thereof and water soluble or dispersible modifications or derivatives thereof, can be used in the composition of the present invention. Modified starches that can be used include natural starches that have been degraded to obtain a lower viscosity by acidic, oxidative or enzymic depolymerization. Additionally, low viscosity commercially available propoxylated and/or ethoxylated starches are useable in the present composition and are preferred since their low viscosity at relatively high solids concentrations makes them very adaptable to spraying processes. Suitable alkoxylated, low viscosity starches are submicron-sized particles of hydrophobic starch that are readily dispersed in water and are prepared by alkoxylation of granular starch with a monofunctional alkoxylating agent that provides the starch with ether linked hydrophilic groups. A suitable method for their preparation is taught in U.S. Pat. No. 3,462,283. In accordance with the invention, the propoxylated or ethoxylated starch derivatives are dispersed in the aqueous medium in an amount of from about 0.1% to about 10%, preferably from about 0.5% to about 6%, more preferably from about 1% to about 4% by weight of the usage composition.

It is preferred that the ultrasonic transmission fluid comprises at least about 0%, more preferably at least about 0.001%, even more preferably, at least about 0.01% even more preferably still, at least about 0.02% by weight of ultrasonic transmission fluid of finishing agents. The ultrasonic transmission fluid will also preferably contain no more than about 15%, more preferably no more than about 10%, even more preferably, no more than about 5%, even more preferably still, no more than about 2% by weight of ultrasonic transmission fluid of finishing agents.

Odor Control Agent

Odor control agents may be included in the compositions of the present invention as an ultrasonic adjuvant. Suitable odor control agents include agents include, cyclodextrins, odor neutralizers, odor blockers and mixtures thereof. Suitable odor neutralizers include aldehydes, flavanoids, metallic salts, water-soluble polymers, zeolites, activated carbon and mixtures thereof.

Cyclodextrins—As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structure with hollow interiors of specific volumes. Hydrogen atoms and glycosidic bridging oxygen atoms form the "lining" of each internal cavity; therefore, this surface is fairly hydrophobic. The unique shape and physical-chemical properties of the cavity enable the cyclodextrin molecules to absorb (form inclusion complexes with) organic molecules or parts of organic molecules that can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. However on a damp or dry fabric, some low molecular weight organic amines and acids have more affinity and will complex with the cyclodextrins more readily.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin are defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

Uncomplexed cyclodextrin molecules, which are made up of varying numbers of glucose units provide the absorbing advantages of known absorbent deodorizing compositions without harmful effects to fabrics. While cyclodextrin is an effective odor-absorbing active, some small molecules are not sufficiently absorbed by the cyclodextrin molecules because the cavity of the cyclodextrin molecule may be too large to adequately hold the smaller organic molecule. If a small sized organic odor molecule is not sufficiently absorbed into the cyclodextrin cavity, a substantial amount of malodor can remain. In order to alleviate this problem, low molecular weight polyols can be added to the composition as discussed hereinafter, to enhance the formation of cyclodextrin inclusion complexes. Furthermore, optional water-soluble metal salts can be added as discussed hereinafter, to complex with some nitrogen-containing and sulfur-containing malodor molecules.

Since cyclodextrin is a prime breeding ground for certain microorganisms, especially when in aqueous compositions, it is preferable to include a water-soluble antimicrobial preservative, which is effective for inhibiting and/or regulating microbial growth, to increase storage stability of aqueous odor-absorbing solutions containing water-soluble cyclodextrin, when the composition does not contain an antimicrobial material as described hereinafter.

It is also desirable to provide optional ingredients such as a cyclodextrin compatible antimicrobial active that provides substantial kill of organisms that cause, e.g., odor, infections, etc. It is also desirable that the compositions contain a cyclodextrin compatible surfactant to promote spreading of the odor absorbing composition on hydrophobic surfaces such as polyester, nylon, etc. as well as to penetrate any oily, hydrophobic soil for improved malodor control. Furthermore, it is desirable that the cyclodextrin-compatible surfactant provides in-wear electrostatic control. It is more preferable that the odor absorbing composition of the present invention contains both a cyclodextrin-compatible antibacterial active and a cyclodextrin-compatible surfactant. A cyclodextrin-compatible active is one which does not substantially form a complex with cyclodextrin in the composition, at the usage concentration, so that an effective amount of both the free, uncomplexed active and free, uncomplexed cyclodextrin are available for their intended uses.

Odor Neutralizers—Odor neutralizers can be used to mitigate the effects of malodors. In order to be effective, the neutralizers must be able to interact with and negate the malodors, such as, by reducing the vapor pressure of the malodor, or alter the malodors chemical structure. If the odor neutralizers evaporate before the source of the odor is gone, it is less likely to control the odor. Also, the odor neutralizers tend to adversely affect aesthetics by neutralizers the wanted odors like perfumes. Suitable odor neutralizers include aldehydes, flavanoids, metallic salts, water-soluble polymers, zeolites, and mixtures thereof.

Suitable odor "blockers" are disclosed in U.S. Pat. Nos. 4,009,253; 4,187,251, 4,719,105; 5,441,727; and 5,861,371, all of which are incorporated herein by reference.

Aldehydes—As an optional ingredient, aldehydes can be used to mitigate the effects of malodors. Suitable aldehydes are class I, class II aldehydes, and mixture of such aldehydes that are disclosed in U.S. Pat. No. 5,676163, said patent being incorporated herein by reference.

Flavanoids—Flavanoids are ingredients found in typical essential oils. Such oils include essential oil extracted by dry distillation from needle leaf trees and grasses such as cedar, Japanese cypress, eucalyptus, Japanese red pine, dandelion, low striped bamboo and cranesbill and it contains terpenic material such as alpha-pinene, beta-pinene, myrcene, phencone and camphene. The terpene type substance is homogeneously dispersed in the finishing agent by the action of nonionic surfactant and is attached to fibers constituting the cloth. Also included are extracts from tealeaf. Descriptions of such materials can be found in JP6219157, JP 02284997, JP04030855, etc. said references being incorporated herein by reference.

Metal Salts—The ultrasonic transmission fluids can include metallic salts for added odor absorption and/or antimicrobial benefit for the cyclodextrin solution. The metallic salts are selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. See U.S. Pat. No. 3,172,817, Leupold, et al., which discloses deodorizing compositions for treating disposable articles, comprising at least slightly water-soluble salts of acylacetone, including copper salts and zinc salts, all of said patents are incorporated herein by reference.

The preferred zinc salts possess malodor control abilities. Zinc has been used most often for its ability to ameliorate malodor, e.g., in mouth wash products, as disclosed in U.S. Pat. No. 4,325,939, issued Apr. 20, 1982 and U.S. Pat. No. 4,469,674 issued Sep. 4, 1983, to N. B. Shah, et al., all of which are incorporated herein by reference. Highly ionized and soluble zinc salts such as zinc chloride, provide the best source of zinc ions. Zinc borate functions as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably the metallic salts are water-soluble zinc salts, copper salts or mixtures thereof, and more preferably zinc salts, especially $ZnCl_2$. These salts are preferably present in the present invention primarily to absorb amine and sulfur-containing compounds that have molecular sizes too small to be effectively complexed with the cyclodextrin molecules. Low molecular weight sulfur-containing materials, e.g., sulfide and mercaptans, are components of many types of malodors, e.g., food odors (garlic, onion), body/perspiration odor, bad breath halitosis, etc. Low molecular weight amines are also components of many malodors, e.g., food odors, body odors, urine, etc.

When zinc salts are used as the metallic salt, and a clear solution is desired, it is preferable that the pH of the solution is adjusted to less than about 7, more preferably less than about 6, most preferably, less than about 5, in order to keep the solution clear.

Water Soluble Polymers—Some water-soluble polymers, e.g., water-soluble cationic polymer and water-soluble anionic polymers can be used in the composition of the present invention to provide additional odor control benefits.

Cationic Polymers—Water-soluble cationic polymers, e.g., those containing amino functionalities, amido functionalities, and mixtures thereof, are useful in the present invention to control certain acid-type odors.

Anionic Polymers, e.g., polyacrylic acid—Water-soluble anionic polymers, e.g., polyacrylic acids and their water-soluble salts are useful in the present invention to control certain amine-type odors. Preferred polyacrylic acids and their alkali metal salts have an average molecular weight of less than about 20,000, more preferably less than 5,000. Polymers containing sulfonic acid groups, phosphoric acid groups, phosphonic acid groups, and their water-soluble salts, and mixtures thereof, and mixtures with carboxylic acid and carboxylate groups, are also suitable.

Water-soluble polymers containing both cationic and anionic functionalities are also suitable. Examples of these polymers are given in U.S. Pat. No. 4,909,986, issued Mar. 20, 1990 to N. Kobayashi and A. Kawazoe, incorporated herein by reference. Another example of water-soluble polymers containing both cationic and anionic functionalities is a copolymer of dimethyldiallyl ammonium chloride and acrylic acid, commercially available under the trade name Merquat 280® from Calgon.

Preferably, an effective amount of water soluble polymer, especially anionic polymer, e.g. polyacrylic acids or their water soluble salts, at a level of from about 0.001% to about 3%, preferably from about 0.005% to about 2%, more preferably from about 0.01% to about 1% by weight of the composition, for improved odor control benefit.

Zeolites—A preferred class of zeolites is characterized as "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites have an advantage over the "high" zeolites. The intermediate zeolites have a higher affinity for amine-type odors, they are more weight efficient for odor absorption because they have a larger surface area, and they are more moisture tolerant and retain more of their odor absorbing capacity in water than the high zeolites. A wide variety of intermediate zeolites suitable for use herein are commercially available as Valfor CP301-68, Valfor® 300-63, Valfor® CP300-35, and Valfor® CP300-56, available from PQ Corporation, and the CBV100® series of zeolites from Conteka.

Zeolite materials marketed under the trade name Abscents® and Smellrite®, available from The Union Carbide Corporation and UOP are also preferred. These materials are typically available as a white powder in the 3–5 micron particle size range. Such materials are preferred over the intermediate zeolites for control of sulfur-containing odors, e.g., thiols, mercaptans.

Odor Blockers—Although not as preferred, "odor blockers" can be used as an odor control agent to mitigate the effects of malodors. In order to be effective, the odor blockers normally have to be present at all times. If the odor blocker evaporates before the source of the odor is gone, it is less likely to control the odor. Also, the odor blockers tend to adversely affect aesthetics by blocking desirable odors like perfumes.

Suitable odor blockers are disclosed in U.S. Pats. Nos. 4,009,253; 4,187,251, 4,719,105; 5,441,727; and 5,861,371, all of which are incorporated herein by reference.

It is preferred that the ultrasonic transmission fluid comprises at least about 0%, more preferably at least about 0.001%, even more preferably, at least about 0.01% even more preferably still, at least about 0.02% by weight of ultrasonic transmission fluid of odor control agents. The ultrasonic transmission fluid will also preferably contain no more than about 15%, more preferably no more than about 10%, even more preferably, no more than about 5%, even more preferably still, no more than about 2% by weight of ultrasonic transmission fluid of odor control agents.

Chelants—Chelants, e.g., ethylenediaminetetraacetic acid (EDTA), hydroxyethylene-diaminetriacetic acid, diethylenetriaminepentaacetic acid, and other aminocarboxylate chelators, and mixtures thereof, and their salts, and mixtures thereof, can optionally be used to increase antimicrobial and preservative effectiveness against Gram-negative bacteria, especially Pseudomonas species. Although sensitivity to EDTA and other aminocarboxylate chelators is mainly a characteristic of Pseudomonas species, other bacterial species highly susceptible to chelators include Achromobacter, Alcaligenes, Azotobacter, Escherichia, Salmonella, Spirillum, and Vibrio. Other groups of organisms also show increased sensitivities to these chelators, including fungi and yeasts. Furthermore, aminocarboxylate chelators can help, e.g., maintaining product clarity, protecting fragrance and perfume components, and preventing rancidity and off odors.

Although these aminocarboxylate chelators may not be potent biocides in their own right, they function as potentiators for improving the performance of other antimicrobials/preservatives in the compositions of the present invention. Aminocarboxylate chelators can potentiate the performance of many of the cationic, anionic, and nonionic antimicrobials/preservatives, phenolic compounds, and isothiazolinones, which are used as antimicrobials/preservatives in the composition of the present invention. Nonlimiting examples of cationic antimicrobials/preservatives potentiated by aminocarboxylate chelators in solutions are chlorhexidine salts (including digluconate, diacetate, and dihydrochloride salts), and Quatemium-15, also known as Dowicil 200, Dowicide Q, Preventol D1, benalkonium chloride, cetrimonium, myristalkonium chloride, cetylpyridinium chloride, lauryl pyridinium chloride, and the like. Nonlimiting examples of useful anionic antimicrobials/preservatives that are enhanced by aminocarboxylate chelators are sorbic acid and potassium sorbate. Nonlimiting examples of useful nonionic antimicrobials/preservatives, which are potentiated by aminocarboxylate chelators, are DMDM hydantoin, phenethyl alcohol, monolaurin, imidazolidinyl urea, and Bronopol (2-bromo-2-nitropropane-1,3-diol).

Examples of useful phenolic antimicrobials/preservatives potentiated by these chelators are chloroxylenol, phenol, tert-butyl hydroxyanisole, salicylic acid, resorcinol, and sodium o-phenyl phenate. Nonlimiting examples of isothiazolinone antimicrobials/preservatives, which are enhanced by aminocarboxylate chelators, are Kathon, Proxel and Promexal.

The ultrasonic transmission fluid may comprise at least about 0%, more preferably at least about 0.001%, even more preferably, at least about 0.01% even more preferably still, at least about 0.02% by weight of ultrasonic transmission fluid of a chelant. The ultrasonic transmission fluid will also preferably contain no more than about 2%, more preferably no more than about 0.3%, even more preferably, no more than about 0.1%, even more preferably still, no more than about 0.05% by weight of ultrasonic transmission fluid of a chelant.

Free, uncomplexed aminocarboxylate chelators are required to potentiate the efficacy of the antimicrobials. Thus, when excess alkaline earth (especially calcium and magnesium) and transitional metals (iron, manganese, copper, and others) are present, free chelators are not available and antimicrobial potentiation is not observed. In the case where significant water hardness or transitional metals are available or where product esthetics require a specified chelator level, higher levels may be required to allow for the availability of free, uncomplexed aminocarboxylate chelators to function as antimicrobial/preservative potentiators.

Polymeric Agents—Polymeric agents can optionally be utilized as an ultrasonic adjuvant. Suitable polymeric agents include polymeric polycarboxylates and polyethylene glycols, although others known in the art can also be used.

It is preferred that the ultrasonic transmission fluid comprises at least about 0%, more preferably at least about 0.001%, even more preferably, at least about 0.01% even more preferably still, at least about 0.02% by weight of ultrasonic transmission fluid of polymeric agents. The ultrasonic transmission fluid will also preferably contain no more than about 15%, more preferably no more than about 10%, even more preferably, no more than about 5%, even more preferably still, no more than about 2% by weight of ultrasonic transmission fluid of polymeric agents.

Polymerizing or copolymerizing suitable unsaturated monomers, preferably in their acid form, can prepare polymeric polycarboxylate materials. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers that are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials that are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material that can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used. Dispersing agents such as polyaspartate preferably have a molecular weight (avg.) of about 10,000.

Other suitable polymer types include various terpolymers and hydrophobically modified copolymers, including those marketed by Rohm & Haas, BASF Corp., Nippon Shokubai and others for all manner of water-treatment, textile treatment, or detergent applications.

Another polymeric material that can be included is vinylpyrrolidone homopolymers and copolymers.

One suitable vinylpyrrolidone homopolymer that can be used herein are homopolymers of N-vinylpyrrolidone having the following repeating monomer:

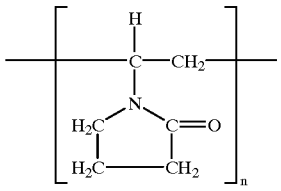

wherein n (degree of polymerization) is an integer of from 10 to 1,000,000, preferably from 20 to 100,000, and more preferably from 20 to 10,000.

Accordingly, suitable vinylpyrrolidone homopolymers ("PVP") which can be used herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K-60® average molecular weight of 160,000), and PVP K-90® (average molecular weight of 360,000). Other suitable vinylpyrrolidone homopolymers that are commercially available from BASF Cooperation include Sokalan HP 165® and Sokalan HP 12®; and vinylpyrrolidone homopolymers known to persons skilled in the detergent field (see for example EP-A-262,897 and EP-A-256,696).

Suitable copolymers of vinylpyrrolidone which can be used herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well-known monomers may be used.

The molecular weight of the copolymer of vinylpyrrolidone is not especially critical so long as the copolymer is water-soluble, has some surface activity and is adsorbed to the hard-surface from the liquid composition or solution (i.e. under dilute usage conditions) comprising it in such a manner as to increase the hydrophilicity of the surface. However, the preferred copolymers of N-vinylpyrrolidone and alkylenically unsaturated monomers or mixtures thereof, have a molecular weight of between 1,000 and 1,000,000, preferably between 10,000 and 500,000 and more preferably between 10,000 and 200,000.

For example particularly suitable N-vinylimidazole N-vinylpyrrolidone polymers for use herein have an average molecular weight range from 5,000–1,000,000, preferably from 5,000 to 500,000, and more preferably from 10,000 to 200,000. The average molecular weight range was determined by light scattering as described in Barth H. G. and Mays J. W. Chemical Analysis Vol. 113, "Modern Methods of Polymer Characterization".

Such copolymers of N-vinylpyrrolidone and alkylenically unsaturated monomers like PVP/vinyl acetate copolymers are commercially available under the trade name Luviskol® series from BASF.

Particular preferred copolymers of vinylpyrrolidone for use in the compositions of the present invention are quaternized or unquaternised vinylpyrrolidone/dialkylaminoalkyl acrylate or methacrylate copolymers.

The vinylpyrrolidone/dialkylaminoalkyl acrylate or methacrylate copolymers (quaternised or unquaternised) suitable for use in the compositions of the present invention are according to the following formula:

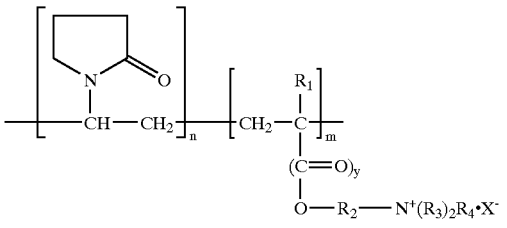

wherein n is between 20 and 99 and preferably between 40 and 90 mol % and m is between 1 and 80 and preferably between 5 and 40 mol %; $R_1$ represents H or $CH_3$; y denotes 0 or 1; $R_2$ is —$CH_2$—CHOH—$CH_2$— or $C_xH_{2x}$, in which x=2 to 18; $R_3$ represents a lower alkyl group of from 1 to 4 carbon atoms, preferably methyl or ethyl, or benzyl; $R_4$ denotes a lower alkyl group of from 1 to 4 carbon atoms, preferably methyl or ethyl; $X^-$ is chosen from the group consisting of Cl, Br, I, ½$SO_4$, $HSO_4$ and $CH_3SO_3$. The process described in French Patent Nos. 2,077,143 and 2,393,573 can prepare these polymers.

The preferred quaternized or unquaternized vinylpyrrolidone/dialkylaminoalkyl acrylate or methacrylate copolymers suitable for use herein have a molecular weight of between 1,000 and 1,000,000, preferably between 10,000 and 500,000 and more preferably between 10,000 and 100,000.

Such vinylpyrrolidone/dialkylaminoalkyl acrylate or methacrylate copolymers are commercially available under the name copolymer 845®, Gafquat 734®, or Gafquat 755® from ISP Corporation, New York, N.Y. and Montreal, Canada or from BASF under the trade name Luviquat®.

Most preferred herein are quaternized copolymers of vinyl pyrrolidone and dimethyl aminoethymethacrylate (polyquatemium-11) available from BASF.

Humectant

Optionally, the composition can contain a humectant to soften both the fabric fibers, especially cotton fibers, and the adhesive and/or film-forming shape retention polymers. Examples suitable humectants are short chain polyhydric alcohols, such as is glycerol, ethylene glycol, propylene glycol, diethylene glycol, dipropylene glycol, sorbitol, erythritol or mixtures thereof, more preferably diethylene glycol, dipropylene glycol, ethylene glycol, propylene glycol and mixtures thereof.

The aqueous compositions containing humectant also tend to provide a slower drying profile for clothing/fabrics, to allow time for any wrinkles to disappear when the clothing/fabrics are hung to dry. This is balanced by the desire by most consumers to have the garments to dry faster. Therefore, when included, the humectant should be used at an effective, but as low as possible, level in the composition. When a humectant is used, it is present in at the level of from about 0.01% to about 5%, preferably from about 0.05% to about 2%, more preferably from about 0.1% to about 1% by weight of the usage composition.

Anti-microbial agents—an anti-microbial agent is a compound or substance that kills microorganisms or prevents or inhibits their growth and reproduction. A properly selected anti-microbial agent maintains stability under use and storage conditions (pH, temperature, light, etc.), for a required length of time. A desirable property of the anti-microbial agent is that it is safe and nontoxic in handling, formulation and use, is environmentally acceptable and cost effective. Classes of anti-microbial agents include, but are not limited to, chlorophenols, aldehydes, biguanides, antibiotics and biologically active salts. Some preferable anti-microbial agent in the antimicrobial is bronopol, chlorhexidine diacetate, TRICLOSAN.TM., hexetidine orparachlorometaxylenol (PCMX). More preferably, the anti-microbial agent is TRICLOSAN.TM, Bardac®, chlorhexidine diacetate or hexetidine.

The solubilized, water-soluble antimicrobial active is useful in providing protection against organisms that become attached to the treated material. The antimicrobial is preferably cyclodextrin-compatible, e.g., not substantially forming complexes with the cyclodextrin in the composition, when cyclodextrin is present. The free, uncomplexed antimicrobial, e.g., antibacterial, active provides an optimum antibacterial performance.

Sanitization of fabrics can be achieved by the compositions of the present invention containing, antimicrobial materials, e.g., antibacterial halogenated compounds, quaternary compounds, and phenolic compounds.

Biguanides. Some of the more robust cyclodextrin-compatible antimicrobial halogenated compounds which can function as disinfectants/sanitizers as well as finish product preservatives (vide infra), and are useful in the compositions of the present invention include 1,1'-hexamethylene bis(5-(p-chlorophenyl)biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water. When chlorhexidine is used as a sanitizer in the present invention it is typically present at a level of from about 0.001% to about 0.4%, preferably from about 0.002% to about 0.3%, and more preferably from about 0.05% to about 0.2%, by weight of the usage composition. In some cases, a level of from about 1% to about 2% may be needed for virucidal activity.

Other useful biguanide compounds include Cosmoci® CQ®, Vantocil® IB, including poly (hexamethylene biguanide) hydrochloride. Other useful cationic antimicrobial agents include the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like.

Examples of suitable bis biguanide compounds are chlorhexidine; 1,6-bis-(2-ethylhexylbiguanidohexane) dihydrochloride; 1,6-di-(Nl,Nl'-phenyldiguanido-$N_5$,$N_5$')-hexane tetrahydrochloride; 1,6-di-($N_1$,$N_1$'-phenyl-$N_1$,$N_1$'-methyldiguanido-$N_5$,$N_5$')-hexane dihydrochloride; 1,6-di ($N_1$,$N_1$ '-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di[$N_1$,$N_1$'-.beta.-(p-methoxyphenyl) diguanido-$N_5$,$N_5$']-hexane dihydrochloride; 1,6-di($N_1$,$N_1$'-.alpha.-methyl-.beta.-phenyldiguanido-$N_5$,$N_5$')-hexane dihydrochloride; 1,6-di($N_1$,$N_1$'-p-nitrophenyldiguanido-$N_5$,$N_5$')hexane dihydrochloride;.omega.:.omega.'-di-($N_1$,$N_1$'-phenyldiguanido-$N_5$,$N_5$')-di-n-propylether dihydrochloride;.omega:omega'-di($N_1$,$N_1$'-p-chlorophenyldiguanido-$N_5$,$N_5$')-di-n-propylether tetrahydrochloride; 1,6-di($N_1$,$N_1$'-2,4-dichlorophenyldiguanido-$N_5$,$N_5$')hexane tetrahydrochloride; 1,6-di($N_1$,$N_1$'-p-methylphenyldiguanido-$N_5$,$N_5$')hexane dihydrochloride; 1,6-di($N_1$,$N_1$'-2,4,5-trichlorophenyldiguanido-$N_5$,$N_5$') hexane tetrahydrochloride; 1,6-di[$N_1$,$N_1$'-.alpha.-(p-chlorophenyl) ethyldiguanido-$N_5$,$N_5$'] hexane dihydrochloride;.omega.:.omega.'di($N_1$, $N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,10-di($N_1$,$N_1$'-phenyldiguanido-$N_5$,$N_5$')-decane tetrahydrochloride; 1,12-di($N_1$,$N_1$'-phenyldiguanido-$N_5$,$N_5$') dodecane tetrahydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; ethylene bis (1-tolyl biguanide); ethylene bis (p-tolyl biguanide); ethylene bis(3,5-dimethylphenyl biguanide); ethylene bis(p-tert-amylphenyl biguanide); ethylene bis(nonylphenyl biguanide); ethylene bis (phenyl biguanide); ethylene bis (N-butylphenyl biguanide); ethylene bis (2,5-diethoxyphenyl biguanide); ethylene bis(2,4-dimethylphenyl biguanide); ethylene bis(o-diphenylbiguanide); ethylene bis(mixed amyl naphthyl biguanide); N-butyl ethylene bis(phenylbiguanide); trimethylene bis(o-tolyl biguanide); N-butyl trimethylene bis (phenyl biguanide); and the corresponding pharmaceutically acceptable salts of all of the above such as the acetates; gluconates; hydrochlorides; hydrobromides; citrates; bisulfites; fluorides; polymaleates; N-coconutalkylsarcosinates; phosphites; hypophosphites; perfluorooctanoates; silicates; sorbates; salicylates; maleates; tartrates; fumarates; ethylenediaminetetraacetates; iminodiacetates; cinnamates; thiocyanates; arginates; pyromellitates; tetracarboxybutyrates; benzoates; glutarates; monofluorophosphates; and perfluoropropionates, and mixtures thereof. Preferred antimicrobials from this group are 1,6-di-($N_1$,$N_1$'-phenyldiguanido-$N_5$,$N_5$')-hexane tetrahydrochloride; 1,6-di($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di($N_1$,$N_1$'-2,4-dichlorophenyldiguanido-$N_5$,$N_5$')hexane tetrahydrochloride; 1,6-di[,$N_1$,$N_1$'-.alpha.-(p-chlorophenyl) ethyldiguanido-$N_5$,$N_5$'] hexane dihydrochloride;.omega.:.omega.'di($N_1$, $N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; and mixtures thereof; more preferably, 1,6-di($N_1$,$N_1$'-o-chlorophenyldiguanido-$N_5$,$N_5$ ')-hexane dihydrochloride; 1,6-di($N_1$,$N_1$'-2,6-dichlorophenydi guanido-$N_5$,$N_5$')hexane dihydrochloride; 1,6-di($N_1$,$N_1$'-2,4-dichlorophenyldiguanido-$N_5$,$N_5$')hexane tetrahydrochloride; 1,6-di[$N_1$,$N_1$'-.alpha.-(p-chlorophenyl) ethyldiguanido-$N_5$,$N_5$'] hexane dihydrochloride;.omega.:.omega.'di($N_1$, $N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; and mixtures thereof. As stated hereinbefore, the bis biguanide of choice is chlorhexidine its salts, e.g., digluconate, dihydrochloride, diacetate, and mixtures thereof.

Quaternary Compounds.

A wide range of quaternary compounds can also be used as antimicrobial actives, for compositions of the present invention that do not contain cyclodextrin. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Witco/Sherex), and Hyamine® (available from Lonza); (2) di($C_6$–$C_{14}$)alkyl di short chain ($C_{14}$ alkyl and/or hydroxyalkl) quaternary such as Bardac® products of Lonza, (3) N-(3-chloroallyl) hexaminium chlorides such as Dowicide® and Dowicil® available from Dow; (4) benzethonium chloride such as Hyamine® 1622 from Rohm & Haas; (5) methylbenzethonium chloride represented by Hyamine® 10X supplied by Rohm & Haas, (6) cetylpyridinium chloride such as Cepacol chloride available from of Merrell Labs. Examples of the preferred dialkyl quaternary compounds are di($C_8$–$C_{12}$)dialkyl dimethyl ammonium chloride, such as didecyldimethylammonium chloride (Bardac 22), and dioctyldimethylammonium chloride (Bardac 2050). Typical concentrations for biocidal effectiveness of these quaternary compounds range from about 0.001% to about 0.8%, preferably from about 0.005% to about 0.3%, more preferably from about 0.01% to about 0.2%, and even more preferably from about 0.03% to about 0.1%, by weight of the usage composition. The corresponding concentrations for the concentrated compositions are from about 0.003% to about 2%, preferably from about 0.006% to about 1.2%, and more preferably from about 0.1% to about 0.8% by weight of the concentrated compositions.

Some surfactants, when added to the antimicrobials tend to provide improved antimicrobial action. This is especially true for the siloxane surfactants, and especially when the siloxane surfactants are combined with the chlorhexidine or Bardac antimicrobial actives.

The anti-microbial agent, when used, is present in a microbiocidally effective amount. It is preferred that the ultrasonic transmission fluid comprises at least about 0%, more preferably at least about 0.01%, even more preferably, at least about 0.01% even more preferably still, at least about 0.02% by weight of ultrasonic transmission fluid of anti-microbial agents. The ultrasonic transmission fluid will also preferably contain no more than about 15%, more preferably no more than about 10%, even more preferably, no more than about 5%, even more preferably still, no more than about 2% by weight of ultrasonic transmission fluid of anti-microbial agents.

Composition pH

Compositions of the invention can have a pH range of from about 2 to about 13, preferably, pH is around typical skin pH (typically neutral to slightly acidic), more preferably from about 4 to about 9, more preferably from about 4.5 to about 8.5, even more preferably from about 5 to about 8. If a composition with a pH greater than 7 is to be more effective, it preferably should contain a buffering agent capable of providing a generally more alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 10. Under these conditions the buffering agent most effectively controls the pH while using the least amount thereof.

The buffering agent may be any suitable buffer such as, a low molecular weight, organic or inorganic material that is used in this composition solely for maintaining pH. Some examples are amino acids such as lysine or lower alcohol amines like mono-, di-, and tri-ethanolamine. Other suitable buffering agents are Tri(hydroxymethyl)amino methane (HOCH2)3CNH3 (TRIS), 2-amino-2-ethyl-1,3-propanediol, 2-amino-2-methyl-propanol, 2-amino-2-methyl-1,3-propanol, disodium glutamate, N-methyl diethanolamide, 1,3-diamino-propanol N,N'-tetra-methyl-1,3-diamino-2-propanol, N,N-bis (2-hydroxyethyl)glycine (bicine), citric acid, lactic acid, and N-tris (hydroxymethyl) methyl glycine (tricine). Mixtures of any of the above are also acceptable. Useful inorganic buffers/alkalinity sources include the alkali metal carbonates alkali metal hydrocarbonates and alkali metal phosphates, e.g., sodium carbonate, sodium hydrogen carbonate sodium polyphosphate. For additional buffers see McCutcheon's EMULSIFIERS AND DETERGENTS, North American Edition, 1997, McCutcheon Division, MC Publishing Company Kirk and WO 95/07971 both of which are incorporated herein by reference.

The buffer, when used, is present in a buffering effective amount. It is preferred that the ultrasonic transmission fluid comprises at least about 0%, more preferably at least about 0.001%, even more preferably, at least about 0.01% even more preferably still, at least about 0.02% by weight of ultrasonic transmission fluid of buffer. The ultrasonic transmission fluid will also preferably contain no more than about 15%, more preferably no more than about 10%, even more preferably, no more than about 5%, even more preferably still, no more than about 2% by weight of ultrasonic transmission fluid of buffer.

Hydrotropes

The ultrasonic transmission fluid may optionally comprise one or more materials that are hydrotropes. Hydrotropes suitable for use in the compositions herein include the $C_1$–$C_3$ alkyl aryl sulfonates, $C_6$–$C_{12}$ alkanols, $C_1$–$C_6$ carboxylic sulfates and sulfonates, urea, $C_1$–$C_6$ hydrocarboxylates, $C_1$–$C_4$ carboxylates, $C_2$–$C_4$ organic diacids and mixtures of these hydrotrope materials. The composition of the present invention preferably contains a hydrotrope selected from alkali metal and calcium xylene and toluene sulfonates.

Suitable $C_1$–$C_3$ alkyl aryl sulfonates include sodium, potassium, calcium and ammonium xylene sulfonates; sodium, potassium, calcium and ammonium toluene sulfonates; sodium, potassium, calcium and ammonium cumene sulfonates; and sodium, potassium, calcium and ammonium substituted or unsubstituted naphthalene sulfonates and mixtures thereof.

Suitable $C_1$–$C_8$ carboxylic sulfate or sulfonate salts are any water-soluble salts or organic compounds comprising 1 to 8 carbon atoms (exclusive of substituent groups), which are substituted with sulfate or sulfonate and have at least one carboxylic group. The substituted organic compound may be cyclic, acylic or aromatic, i.e. benzene derivatives. Preferred alkyl compounds have from 1 to 4 carbon atoms substituted with sulfate or sulfonate and have from 1 to 2 carboxylic groups. Examples of this type of hydrotrope include sulfosuccinate salts, sulfophthalic salts, sulfoacetic salts, m-sulfobenzoic acid salts and diester sulfosuccinates, preferably the sodium or potassium salts as disclosed in U.S. Pat. No. 3,915,903.

Suitable $C_1$–$C_4$ hydrocarboxylates and $C_1$–$C_4$ carboxylates for use herein include acetates and propionates and citrates. Suitable $C_2$–$C_4$ diacids for use herein include succinic, glutaric and adipic acids.

Other compounds that deliver hydrotropic effects suitable for use herein as a hydrotrope include $C_6$–$C_{12}$ alkanols and urea.

Preferred hydrotropes for use herein are sodium, potassium, calcium and ammonium cumene sulfonate; sodium, potassium, calcium and ammonium xylene sulfonate; sodium, potassium, calcium and ammonium toluene sulfonate and mixtures thereof. Most preferred are sodium cumene sulfonate and calcium xylene sulfonate and mixtures thereof. These preferred hydrotrope materials when used are present in the composition to the extent of from.

The hydrotrope, when used, is present in an effective amount. It is preferred that the ultrasonic transmission fluid comprises at least about 0%, more preferably at least about 0.001%, even more preferably, at least about 0.01% even more preferably still, at least about 0.02% by weight of ultrasonic transmission fluid of hydrotrope. The ultrasonic transmission fluid will also preferably contain no more than about 15%, more preferably no more than about 10%, even more preferably, no more than about 5%, even more preferably still, no more than about 2% by weight of ultrasonic transmission fluid of hydrotrope.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients.

Non-limiting examples of perfume ingredients useful herein include: 7-acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxy-phenyl-butanone; benzophenone; methyl beta-naphthyl ketone; 6-acetyl-1,1,2,3,3,5-hexamethyl indane; 5-acetyl-3-isopropyl-1,1,2,6-tetramethyl indane; 1-dodecanal, 4-(4-hydroxy-4-methylpentyl)-3-cyclohexene-1-carboxaldehyde; 7-hydroxy-3,7-dimethyl ocatanal; 10-undecen-1-al; iso-hexenyl cyclohexyl carboxaldehyde; formyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)-propionaldehyde; ethyl vanillin; heliotropin; hexyl cinnamic aldehyde; amyl cinnamic aldehyde; 2-methyl-2-(para-iso-propylphenyl)-propionaldehyde; coumarin; decalactone gamma; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; beta-naphthol methyl ether; ambroxane; dodecahydro-3a,6,6,9a-tetramethyl-naphtho[2,1b]furan; cedrol, 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; tricyclodecenyl propionate; tricyclodecenyl acetate; benzyl salicylate; cedryl acetate; and para-(tert-butyl) cyclohexyl acetate.

Other perfume materials include essential oils, resinoids, and resins from a variety of sources including, but not limited to: Peru balsam, Olibanum resinoid, styrax, labdanum resin, nutmeg, cassia oil, benzoin resin, coriander and lavandin. Still other perfume chemicals include phenyl ethyl alcohol, terpineol, linalool, linalyl acetate, geraniol, nerol, 2-(1,1-dimethylethyl)-cyclohexanol acetate, benzyl acetate, and eugenol. Carriers such as diethylphthalate can be used in the finished perfume compositions.

The perfume, when used, is present in an effective amount. It is preferred that the ultrasonic transmission fluid comprises at least about 0%, more preferably at least about 0.001%, even more preferably, at least about 0.01% even more preferably still, at least about 0.02% by weight of ultrasonic transmission fluid of perfume. The ultrasonic transmission fluid will also preferably contain no more than about 15%, more preferably no more than about 10%, even more preferably, no more than about 5%, even more preferably still, no more than about 2% by weight of ultrasonic transmission fluid of perfume.

Hydrophobic Perfume Ingredients

In order to provide long lasting effects, the perfume may be at least partially hydrophobic and have a relatively high boiling point. I.e., it is composed predominantly of ingredients selected from two groups of ingredients, namely, (a) hydrophilic ingredients having a ClogP of more than about 3, more preferably more than about 3.5, and (b) ingredients having a molecular weight above about 210, preferably above about 220. Typically, at least about 50%, preferably at least about 60%, more preferably at least about 70%, and most preferably at least about 80% by weight of the perfume is composed of perfume ingredients of the above groups (a) and (b). For these perfumes, the cyclodextrin to perfume weight ratio, when both are present, is typically of from about 2:1 to about 200:1; preferably from about 4:1 to about 100:1, more preferably from about 6:1 to about 50:1, and even more preferably from about 8:1 to about 30:1.

Hydrophobic perfume ingredients have a tendency to complex with the cyclodextrins. The degree of hydrophobicity of a perfume ingredient can be correlated with its octanol/water partition coefficient P. The octanol/water partition coefficient of a perfume ingredient is the ratio between its equilibrium concentration in octanol and in water. A perfume ingredient with a greater partition coefficient P is considered to be more hydrophobic. Conversely, a perfume ingredient with a smaller partition coefficient P is considered to be more hydrophilic. Since the partition coefficients of the perfume ingredients normally have high values, they are more conveniently given in the form of their logarithm to the base 10, logP. Thus the preferred perfume hydrophobic perfume ingredients of this invention have a logP of about 3 or higher, preferably of about 3.5 or higher.

The logP of many perfume ingredients have been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are used instead of the experimental logP values in the selection of perfume ingredients which are useful in the present invention.

Non-limiting examples of the more preferred hydrophobic (enduring) perfume ingredients are selected from the group consisting of: diethyl phthalate, methyl dihydro jasmonate, lyral, hexyl salicylate, iso-E super, hexyl cinnamic aldehyde, iso-propyl myristate, galaxolide, phenyl-ethyl-phenyl acetate, cis-jasmone; dimethyl benzyl carbinyl acetate; ethyl vanillin; geranyl acetate; alpha-ionone; beta-ionone; gamma-ionone; lauric aldehyde; methyl dihydrojasmonate; methyl nonyl acetaldehyde; gamma-nonalactone; phenoxy ethyl iso-butyrate; phenyl ethyl dimethyl carbinol; phenyl ethyl dimethyl carbinyl acetate; alpha-methyl-4-(2-methylpropyl)-benzenepropanal (Suzaral T); 6-acetyl-1,1,3,4,4,6-hexamethyl tetrahydronaphthalene (Tonalid); undecylenic aldehyde; vanillin; 2,5,5-trimethyl-2-pentyl-cyclopentanone (veloutone); 2-tert-butylcyclohexanol (verdol); verdox; para-tert-butylcyclohexyl acetate (vertenex); and mixtures thereof. Enduring perfume compositions can be formulated using these enduring perfume ingredients, preferably at a level of at least about 5%, more preferably at least about 10%, and even more preferably at least about 20%, by weight of the enduring perfume composition, the total level of enduring perfume ingredients, as disclosed herein, being at least about 70%, all by weight of said enduring perfume composition.

Other enduring perfume ingredients that can be used with the above named enduring perfume ingredients can be characterized by boiling point (B.P.) and octanol/water partitioning coefficient (P). The octanol/water partitioning coefficient of a perfume ingredient is the ratio between its equilibrium concentrations in octanol and in water. These other enduring perfume ingredients of this invention have a molecular weight of more than about 210, preferably more than about 220; and an octanol/water partitioning coefficient P of about 1,000 or higher. Since the partitioning coefficients of these other enduring perfume ingredients of this invention have high values, they are more conveniently given in the form of their logarithm to the base 10, logP. Thus these other enduring perfume ingredients of this invention have logP of about 3 or higher, preferably more than about 3.1, and even more preferably more than about 3.2.

The following table illustrates the molecular weight property of some of the preferred perfume versus non-preferred perfume components.

Examples of Perfume Components for CD Interaction

| Perfume component | Molecular weight | CD interaction |
|---|---|---|
| Diethyl Phthalate | 222.0 | weak |
| Methyl Dihydro Jasmonate | 226.3 | weak |
| Lyral | 210.3 | weak |
| Hexyl Salicylate | 222.3 | weak |
| Iso-E Super | 234.0 | weak |
| Hexyl cinnamic Aldehyde | 216.3 | weak |
| Iso-propyl Myristate | 270.0 | weak |
| Galaxolide | 258 | weak |
| Tonalid | 258 | weak |
| Phenyl-Ethyl-Phenyl Acetate | 240 | weak |
| Tetrahydrolinalol | 158.0 | significant |
| Koavone | 182.0 | strong |
| Terpinyl Acetate | 196.0 | significant |
| Vertenex | 198.3 | strong |
| Flor Acetate | 192.0 | strong |
| a-ionone | 192.3 | strong |
| Cymal | 170.0 | strong |
| a-Me Ionone | 206.3 | strong |
| Frutene | 206.0 | strong |
| Lilial | 204.3 | strong |

Nonlimiting examples of other preferred hydrophobic perfume ingredients that can be used in perfume compositions of this invention are:

Examples of Other Enduring Perfume Ingredients

| Perfume Ingredients | Approximate B.P. (° C.) (a) | Approximate ClogP |
|---|---|---|
| BP ≧ 250° C. and ClogP ≧ 3.0 | | |
| Allyl cyclohexane propionate | 267 | 3.935 |
| Ambrettolide | 300 | 6.261 |
| Ambrox DL (Dodecahydro-3a,6,6,9a-tetramethyl-naphtho[2,1-b]furan) | 250 | 5.400 |
| Amyl benzoate | 262 | 3.417 |
| Amyl cinnamate | 310 | 3.771 |
| Amyl cinnamic aldehyde | 285 | 4.324 |
| Amyl cinnamic aldehyde dimethyl acetal | 300 | 4.033 |
| iso-Amyl salicylate | 277 | 4.601 |

-continued

| Perfume Ingredients | Approximate B.P. (° C.) (a) | Approximate ClogP |
|---|---|---|
| Aurantiol | 450 | 4.216 |
| Benzophenone | 306 | 3.120 |
| Benzyl salicylate | 300 | 4.383 |
| para-tert-Butyl cyclohexyl acetate | +250 | 4.019 |
| iso-Butyl quinoline | 252 | 4.193 |
| beta-Caryophyllene | 256 | 6.333 |
| Cadinene | 275 | 7.346 |
| Cedrol | 291 | 4.530 |
| Cedryl acetate | 303 | 5.436 |
| Cedryl formate | +250 | 5.070 |
| Cinnamyl cinnamate | 370 | 5.480 |
| Cyclohexyl salicylate | 304 | 5.265 |
| Cyclamen aldehyde | 270 | 3.680 |
| Dihydro isojasmonate | +300 | 3.009 |
| Diphenyl methane | 262 | 4.059 |
| Diphenyl oxide | 252 | 4.240 |
| Dodecalactone | 258 | 4.359 |
| iso E super | +250 | 3.455 |
| Ethylene brassylate | 332 | 4.554 |
| Ethyl methyl phenyl glycidate | 260 | 3.165 |
| Ethyl undecylenate | 264 | 4.888 |
| Exaltolide | 280 | 5.346 |
| Galaxolide | +250 | 5.482 |
| Geranyl anthranilate | 312 | 4.216 |
| Geranyl phenyl acetate | +250 | 5.233 |
| Hexadecanolide | 294 | 6.805 |
| Hexenyl salicylate | 271 | 4.716 |
| Hexyl cinnamic aldehyde | 305 | 5.473 |
| Hexyl salicylate | 290 | 5.260 |
| alpha-Irone | 250 | 3.820 |
| Lilial (p-t-bucinal) | 258 | 3.858 |
| Linalyl benzoate | 263 | 5.233 |
| 2-Methoxy naphthalene | 274 | 3.235 |
| gamma-n-Methyl ionone | 252 | 4.309 |
| Musk indanone | +250 | 5.458 |
| Musk ketone | MP = 137° C. | 3.014 |
| Musk tibetine | MP = 136° C. | 3.831 |
| Myristicin | 276 | 3.200 |
| Oxahexadecanolide-10 | +300 | 4.336 |
| Oxahexadecanolide-11 | MP = 35° C. | 4.336 |
| Patchouli alcohol | 285 | 4.530 |
| Phantolide | 288 | 5.977 |
| Phenyl ethyl benzoate | 300 | 4.058 |
| Phenyl ethyl phenyl acetate | 325 | 3.767 |
| Phenyl heptanol | 261 | 3.478 |
| Phenyl hexanol | 258 | 3.299 |
| alpha-Santalol | 301 | 3.800 |
| Thibetolide | 280 | 6.246 |
| delta-Undecalactone | 290 | 3.830 |
| gamma-Undecalactone | 297 | 4.140 |
| Undecavertol (4-methyl-3-decen-5-ol) | 250 | 3.690 |
| Vetiveryl acetate | 285 | 4.882 |
| Yara-yara | 274 | 3.235 |
| Ylangene | 250 | 6.268 |

(a) M.P. is melting point; these ingredients have a B.P. (boiling point) higher than about 250° C.

The preferred perfume compositions used in the present invention contain at least 4 different hydrophobic perfume ingredients, preferably at least 5 different hydrophobic perfume ingredients, more preferably at least 6 different hydrophobic perfume ingredients, and even more preferably at least 7 different hydrophobic perfume ingredients. Most common perfume ingredients that are derived from natural sources are composed of a multitude of components. When each such material is used in the formulation of the preferred perfume compositions of the present invention, it is counted as one single ingredient, for the purpose of defining the invention.

Low Odor Detection Threshold Perfume Ingredient

The composition can also contain low to moderate levels of low odor detection threshold materials, either dissolved in the aqueous phase to the extent of their water solubility or incorporated into the emulsion or dispersion with the other hydrophobic perfume ingredients. The odor detection threshold is the lowest vapor concentration of that material which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of perfume ingredients that have low odor detection threshold values can improve perfume odor character. Perfume ingredients that have a significantly low detection threshold, useful in the composition of the present invention, are selected from the group consisting of ambrox, bacdanol, benzyl salicylate, butyl anthranilate, cetalox, damascenone, alpha-damascone, gamma-dodecalactone, ebanol, herbavert, cis-3-hexenyl salicylate, alpha-ionone, beta-ionone, alpha-isomethylionone, lilial, methyl nonyl ketone, gamma-undecalactone, undecylenic aldehyde, and mixtures thereof. These materials are preferably present at low levels, typically less than about 30%, preferably less than about 20%, more preferably less than about 15%, by weight of the total perfume compositions of the present invention. However, only low levels are required to provide an effect.

There are also hydrophilic ingredients that have a significantly low detection threshold, and are especially useful in the composition of the present invention. Examples of these ingredients are allyl amyl glycolate, anethole, benzyl acetone, calone, cinnamic alcohol, coumarin, cyclogalbanate, Cyclal C, cymal, 4-decenal, dihydro isojasmonate, ethyl anthranilate, ethyl-2-methyl butyrate, ethyl methylphenyl glycidate, ethyl vanillin, eugenol, flor acetate, florhydral, fructone, frutene, heliotropin, keone, indole, iso cyclo citral, isoeugenol, lyral, methyl heptine carbonate, linalool, methyl anthranilate, methyl dihydrojasmonate, methyl isobutenyl tetrahydropyran, methyl beta naphthyl ketone, beta naphthol methyl ether, nerol, para-anisic aldehyde, para hydroxy phenyl butanone, phenyl acetaldehyde, vanillin, and mixtures thereof. Use of low odor detection threshold perfume ingredients minimizes the level of organic material that is released into the atmosphere.

In order to provide compatibility with the cyclodextrin, when present, the perfume ingredients that are hydrophobic, are preferably in a stable emulsion/dispersion. The particles of the emulsion/dispersion are preferably at least 0.01 micron in diameter, more preferably at least 0.05 micron in diameter. The emulsion is formed first and stabilized before the cyclodextrin is added. The preferred stabilizers are the siloxane surfactants described hereinafter; polymers containing both hydrophobic and hydrophilic portions; and cationic fabric softening actives in the form of stable vesicles in the desired particle size range. Thus, the composition comprises a stable hydrophobic perfume suspension (emulsion/dispersion) having a particle size of at least 0.01 micron, preferably at least 0.05 micron in diameter.

Perfume stabilizers include the siloxane surfactants hereinbefore described.

The fabric softener actives can also function as stabilizers for perfumes. Suitable cationic fabric softener actives are described in detail in U.S. Pat. No. 5,747,443, Wahl et al. issued May 5, 1998; U.S. Pat. No. 5,830,845, Trinh et al. issued Nov. 3, 1998; U.S. Pat. No. 5,759,990, Wahl et al. issued Jun. 2, 1998; U.S. Pat. No. 5,686,376, Rusche et al. issued Nov. 11, 1997; U.S. Pat. No. 5,500,138, Bacon et al., issued Mar. 19, 1996; U.S. Pat. No. 5,545,340, Wahl et al., issued Aug. 13, 1996; U.S. Pat. No. 5,804,219, Trinh et al. issued Sep. 8, 1998; and U.S. Pat. No. 4,661,269, Trinh et al., issued Apr. 28, 1987, all of said patents being incorporated herein by reference. The softener actives, with the perfume, are formed into a dispersion before the cyclodextrin is added with the bulk of the water.

Brightener—Any optical brighteners or other brightening or whitening agents known in the art can be used herein. Commercial optical brighteners that may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners that are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-stryl-phenyl)-2H-napthol[1,2-d]triazoles; 4,4'-bis-(1,2,3-triazol-2-yl)-stil-benes; 4,4'-bis(stryl)bisphenyls; and the aminocoumarins. Specific examples of these brighteners include 4-methyl-7-diethyl-amino coumarin; 1,2-bis(-venzimidazol-2-yl)ethylene; 1,3-diphenyl-phrazolines; 2,5-bis(benzoxazol-2-yl)thiophene; 2-stryl-napth-[1,2-d]oxazole; and 2-(stilbene-4-yl)-2H-naphtho-[1,2-d]triazole. See also U.S. Pat. No. 3,646,015, issued February 29, 1972 to Hamilton. Anionic brighteners are preferred herein.

The brighteners, when used, are present in an effective amount. It is preferred that the ultrasonic transmission fluid comprises at least about 0%, more preferably at least about 0.01%, even more preferably, at least about 0.01% even more preferably still, at least about 0.02% by weight of ultrasonic transmission fluid of brighteners. The ultrasonic transmission fluid will also preferably contain no more than about 15%, more preferably no more than about 10%, even more preferably, no more than about 5%, even more preferably still, no more than about 2% by weight of ultrasonic transmission fluid of brighteners.

Preservative—Optionally, the composition can contain an effective amount of solubilized, water-soluble, antimicrobial preservative. It is preferred that the ultrasonic transmission fluid comprises at least about 0%, more preferably at least about 0.0001%, even more preferably, at least about 0.0002% even more preferably still, at least about 0.0003% by weight of ultrasonic transmission fluid of a preservative. The ultrasonic transmission fluid will also preferably contain no more than about 0.5%, more preferably no more than about 0.5%, even more preferably, no more than about 0.2%, even more preferably still, no more than about 0.1% by weight of ultrasonic transmission fluid of a preservative.

Optionally, but preferably, solubilized, water-soluble, antimicrobial preservative can be added to the composition of the present invention if the antimicrobial material is not sufficient, or is not present, when cyclodextrin is present, because cyclodextrin molecules are made up of varying numbers of glucose units which can make them a prime breeding ground for certain microorganisms, especially when in aqueous compositions. This drawback can lead to the problem of storage stability of cyclodextrin solutions for any significant length of time. Contamination by certain microorganisms with subsequent microbial growth can result in an unsightly and/or malodorous solution. Because microbial growth in cyclodextrin solutions is highly objectionable when it occurs, it is highly preferable to include a solubilized, water-soluble, antimicrobial preservative, which is effective for inhibiting and/or regulating microbial growth in order to increase storage stability of the ultrasonic transmission fluid containing water-soluble cyclodextrin.

Typical microorganisms that can be found in cyclodextrin supplies and whose growth can be found in the presence of cyclodextrin in aqueous cyclodextrin solutions include bacteria, e.g., *Bacillus thuringiensis* (cereus group) and *Bacillus sphaericus*; and fungi, e.g., *Aspergillus ustus*. *Bacillus sphaericus* is one of the most numerous members of Bacillus species in soils. *Aspergillus ustus* is common in grains and flours, which are raw materials to produce cyclodextrins. Microorganisms such as *Escherichia coli* and *Pseudomonas aeruginosa* are found in some water sources, and can be introduced during the preparation of cyclodextrin solutions. Other Pseudomonas species, such as *P. cepacia*, are typical microbial contaminants in surfactant manufacturing facilities and may readily contaminate packed finished products. Typical other bacterial contaminants may include Burkholderia, Enterobacter and Gluconobacter species. Representative fungal species, which may be associated with agricultural soils, crops and in the case of this invention, corn products such as cyclodextrins include Aspergillus, Absidia, Penicillium, Paecilomyces, and other species.

It is preferable to use a broad spectrum preservative, e.g., one that is effective on both bacteria (both gram positive and gram negative) and fungi. A limited spectrum preservative, e.g., one that is only effective on a single group of microorganisms, e.g., fungi, can be used in combination with a broad spectrum preservative or other limited spectrum preservatives with complimentary and/or supplementary activity. A mixture of broad-spectrum preservatives can also be used. In some cases where a specific group of microbial contaminants is problematic (such as Gram negatives), aminocarboxylate chelators may be used alone or as potentiators in conjunction with other preservatives. These chelators, which include, e.g., ethylenediaminetetraacetic acid (EDTA), hydroxyethylenediaminetriacetic acid, diethylenetriaminepentaacetic acid, and other aminocarboxylate chelators, and mixtures thereof, and their salts, and mixtures thereof, can increase preservative effectiveness against Gram-negative bacteria, especially Pseudomonas species.

Antimicrobial preservatives useful in the present invention include biocidal compounds, i.e., substances that kill microorganisms, or biostatic compounds, i.e., substances that inhibit and/or regulate the growth of microorganisms. Preferred antimicrobial preservatives, when cyclodextrin is present, are those that are water-soluble and are effective at low levels because the organic preservatives can form inclusion complexes with the cyclodextrin molecules and compete with the malodorous molecules for the cyclodextrin cavities, thus rendering the cyclodextrins ineffective as odor controlling actives. Water-soluble preservatives useful in the present invention are those that have a solubility in water of at least about 0.3 g per 100 ml of water, i.e., greater than about 0.3% at room temperature, preferably greater than about 0.5% at room temperature. These types of preservatives have a lower affinity to the cyclodextrin cavity, at least in the aqueous phase, and are therefore more available to provide antimicrobial activity. Preservatives with a water-solubility of less than about 0.3% and a molecular structure that readily fits into the cyclodextrin cavity, have a greater tendency to form inclusion complexes with the cyclodextrin molecules, thus rendering the preservative less effective to control microbes in the cyclodextrin solution. Therefore, many well known preservatives such as short chain alkyl esters of p-hydroxybenzoic acid, commonly known as parabens; N-(4-chlorophenyl)-N'-(3,4-dichlorophenyl) urea, also known as 3,4,4'-trichlorocarbanilide or triclocarban; 2,4,4'-trichloro-2'-hydroxy diphenyl ether, commonly known as triclosan are not preferred in the present invention since they are relatively ineffective when used in conjunction with cyclodextrin.

The water-soluble antimicrobial preservative in the present invention is included at an effective amount. The term "effective amount" as herein defined means a level sufficient to prevent spoilage, or prevent growth of inadvertently added microorganisms, for a specific period of time. In other words, the preservative is not being used to kill microorganisms on the surface onto which the composition is deposited in order to eliminate odors produced by microorganisms. Instead, it is preferably being used to prevent spoilage of the cyclodextrin solution in order to increase the shelf life of the composition.

In order to reserve most of the cyclodextrins for odor control, the cyclodextrin to preservative molar ratio should be greater than about 5:1, preferably greater than about 10:1, more preferably greater than about 50:1, even more preferably greater than about 100:1.

The preservative can be any organic preservative material that will not cause damage to fabric appearance, e.g., discoloration, coloration, and bleaching. Preferred water-soluble preservatives include organic sulfur compounds, halogenated compounds, cyclic organic nitrogen compounds, low molecular weight aldehydes, quaternary ammonium compounds, dehydroacetic acid, phenyl and phenolic compounds, and mixtures thereof.

The following are non-limiting examples of preferred water-soluble preservatives for use in the present invention.

Preferred water-soluble preservatives for use in the present invention are organic sulfur compounds. Some non-limiting examples of organic sulfur compounds suitable for use in the present invention are:

3-Isothiazolone Compounds—A preferred preservative is an antimicrobial, organic preservative containing 3-isothiazolone groups having the formula:

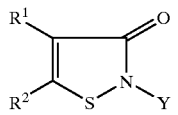

wherein Y is an unsubstituted alkyl, alkenyl, or alkynyl group of from about 1 to about 18 carbon atoms, an unsubstituted or substituted cycloalkyl group having from about a 3 to about a 6 carbon ring and up to 12 carbon atoms, an unsubstituted or substituted aralkyl group of up to about 10 carbon atoms, or an unsubstituted or substituted aryl group of up to about 10 carbon atoms;

$R^1$ is hydrogen, halogen, or a $(C_1–C_4)$ alkyl group; and $R^2$ is hydrogen, halogen, or $(C_1–C_4)$ alkyl.

Preferably, when Y is methyl or ethyl, $R^1$ and $R^2$ should not both be hydrogen. Salts of these compounds formed by reacting the compound with acids such as hydrochloric, nitric, sulfuric, etc. are also suitable.

This class of compounds is disclosed in U.S. Pat. No. 4,265,899, Lewis et al., issued May 5, 1981, and incorporated herein by reference. Examples of said compounds are: 5-chloro-2-methyl-4-isothiazolin-3-one; 2-n-butyl-3-isothiazolone; 2-benzyl-3-isothiazolone; 2-phenyl-3-isothiazolone, 2-methyl-4,5-dichloroisothiazolone; 5-chloro-2-methyl-3-isothiazolone; 2-methyl-4-isothiazolin-3-one; and mixtures thereof. A preferred preservative is a water-soluble mixture of 5-chloro-2-methyl-4-isothiazolin-3-one and 2-methyl-4-isothiazolin-3-one, more preferably a mixture of about 77% 5-chloro-2-methyl-4-isothiazolin-3-one and about 23% 2-methyl-4-isothiazolin-3-one, a broad spectrum preservative available as a 1.5% aqueous solution under the trade name Kathon® CG by Rohm and Haas Company.

When Kathon® is used as the preservative in the present invention it is present at a level of from about 0.0001% to about 0.01%, preferably from about 0.0002% to about 0.005%, more preferably from about 0.0003% to about 0.003%, most preferably from about 0.0004% to about 0.002%, by weight of the composition.

Other isothiazolins include 1,2-benzisothiazolin-3-one, available under the trade name Proxel® products; and 2-methyl-4,5-trimethylene-4-isothiazolin-3-one, available under the trade name Promexal®. Both Proxel and Promexal are available from Aubcia. They have stability over a wide pH range (i.e., 4–12). Neither contains active halogen and is not formaldehyde releasing preservatives. Both Proxel and Promexal are effective against typical Gram negative and positive bacteria, fungi and yeasts when used at a level from about 0.001% to about 0.5%, preferably from about 0.005% to about 0.05%, and most preferably from about 0.01% to about 0.02% by weight of the usage composition.

Sodium Pyrithione—Another preferred organic sulfur preservative is sodium pyrithione, with water solubility of about 50%. When sodium pyrithione is used as the preservative in the present invention it is typically present at a level of from about 0.0001% to about 0.01%, preferably from about 0.0002% to about 0.005%, more preferably from about 0.0003% to about 0.003%, by weight of the usage composition.

Mixtures of the preferred organic sulfur compounds can also be used as the preservative in the present invention.

Halogenated Compounds—Preferred preservatives for use in the present invention are halogenated compounds. Some non-limiting examples of halogenated compounds suitable for use in the present invention are:

One suitable halogenated compound is 5-bromo-5-nitro-1,3-dioxane, available under the trade name Bronidox L® from Henkel. Bronidox L® has a solubility of about 0.46% in water. When Bronidox is used as the preservative in the present invention it is typically present at a level of from about 0.0005% to about 0.02%, preferably from about 0.001% to about 0.01%, by weight of the usage composition.

2-bromo-2-nitropropane-1,3-diol, available under the trade name Bronopol® from Inolex can be used as the preservative in the present invention. Bronopol has a solubility of about 25% in water. When Bronopol is used as the preservative in the present invention it is typically present at a level of from about 0.002% to about 0.1%, preferably from about 0.005% to about 0.05%, by weight of the usage composition.

1,1'-hexamethylene bis(5-(p-chlorophenyl)biguanide), commonly known as chlorhexidine, and its salts, e.g., with acetic and gluconic acids can be used as a preservative in the present invention. The digluconate salt is highly water-soluble, about 70% in water, and the diacetate salt has a solubility of about 1.8% in water. When chlorhexidine is used as the preservative in the present invention it is typically present at a level of from about 0.0001% to about 0.04%, preferably from about 0.0005% to about 0.01%, by weight of the usage composition.

1,1,1-Trichloro-2-methylpropan-2-ol, commonly known as chlorobutanol, with water solubility of about 0.8%; a typical effective level of chlorobutanol is from about 0.1% to about 0.5%, by weight of the usage composition.

4,4'-(Trimethylenedioxy)bis-(3-bromobenzamidine) diisethionate, or dibromopropamidine, with water solubility of about 50%; when dibromopropamidine is used as the preservative in the present invention it is typically present at a level of from about 0.0001% to about 0.05%, preferably from about 0.0005% to about 0.01% by weight of the usage composition.

Mixtures of the preferred halogenated compounds can also be used as the preservative in the present invention.

Cyclic Organic Nitrogen Compounds—Preferred water-soluble preservatives for use in the present invention are cyclic organic nitrogen compounds. Some non-limiting examples of cyclic organic nitrogen compounds suitable for use in the present invention are:

Imidazolidinedione Compounds—Preferred preservatives for use in the present invention are imidazolidione compounds. Some non-limiting examples of imidazolidinedione compounds suitable for use in the present invention are:

One suitable imidazolidione compound is 1,3-bis (hydroxymethyl)-5,5-dimethyl-2,4-imidazolidinedione, commonly known as dimethyloldimethylhydantoin, or DMDM hydantoin, available as, e.g., Glydant® from Lonza. DMDM hydantoin has a water solubility of more than 50% in water, and is mainly effective on bacteria. When DMDM hydantoin is used, it is preferable that it be used in combination with a broad spectrum preservative such as Kathon CG®, or formaldehyde. A preferred mixture is about a 95:5 DMDM hydantoin to 3-butyl-2-iodopropynylcarbamate, available under the trade name Glydant Plus® from Lonza. When Glydant Plus® is used as the preservative in the present invention, it is typically present at a level of from about 0.005% to about 0.2% by weight of the usage composition.

N-[1,3-bis(hydroxymethyl)2,5-dioxo-4-imidazolidinyl]-N,N'-bis(hydroxymethyl) urea, commonly known as diazolidinyl urea, available under the trade name Germall II® from Sutton Laboratories, Inc. (Sutton) can be used as the preservative in the present invention. When Germall II® is used as the preservative in the present invention, it is typically present at a level of from about 0.01% to about 0.1% by weight of the usage composition.

N,N"-methylenebis{N'-[1-(hydroxymethyl)-2,5-dioxo-4-imidazolidinyl]urea}, commonly known as imidazolidinyl urea, available, e.g., under the trade name Abiol® from 3V-Sigma, Unicide U-13® from Induchem, Germall 115® from (Sutton) can be used as the preservative in the present invention. When imidazolidinyl urea is used as the preservative, it is typically present at a level of from about 0.05% to about 0.2%, by weight of the usage composition.

Mixtures of the preferred imidazolidinedione compounds can also be used as the preservative in the present invention.

Polymethoxy Bicyclic Oxazolidine

Another preferred water-soluble cyclic organic nitrogen preservative is polymethoxy bicyclic oxazolidine, having the general formula:

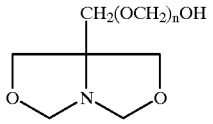

wherein n has a value of from about 0 to about 5, and is available under the trade name Nuosept® C from Hüls America. When Nuosept® C is used as the preservative, it is typically present at a level of from about 0.005% to about 0.1%, by weight of the usage composition.

Mixtures of the preferred cyclic organic nitrogen compounds can also be used as the preservative in the present invention.

Low Molecular Weight Aldehydes—A preferred preservative for use in the present invention is formaldehyde. Formaldehyde is a broad spectrum preservative which is normally available as formalin, which is a 37% aqueous solution of formaldehyde. When formaldehyde is used as the preservative in the present invention, typical levels are from about 0.003% to about 0.2%, preferably from about 0.008% to about 0.1%, more preferably from about 0.01% to about 0.05%, by weight of the usage composition.

A preferred preservative for use in the present invention is glutaraldehyde. Glutaraldehyde is a water-soluble, broad-spectrum preservative commonly available as a 25% or a 50% solution in water. When glutaraldehyde is used as the preservative in the present invention it is typically present at a level of from about 0.005% to about 0.1%, preferably from about 0.01% to about 0.05%, by weight of the usage composition.

Quaternary Compounds—Preferred preservatives for use in the present invention are cationic and/or quaternary compounds. Such compounds include polyaminopropyl biguanide, also known as polyhexamethylene biguanide having the general formula:

$$HCl.NH_2—(CH_2)_3—[—(CH_2)_3—NH—C(=NH)—NH—C(=NH.HCl)—NH—(CH_2)_3—]_x—(CH_2)_3—NH—C(=NH)—NH.HCl$$

Polyaminopropyl biguanide is a water-soluble, broad-spectrum preservative, which is available as a 20% aqueous solution available under the trade name Cosmocil CQ® from ICI Americas, Inc., or under the trade name Mikrokill® from Brooks, Inc.

1-(3-Chlorallyl)-3,5,7-triaza-1-azoniaadamantane chloride, available, e.g., under the trade name Dowicil 200 from Dow Chemical, is an effective quaternary ammonium preservative; it is freely soluble in water; however, it has the tendency to discolor (yellow), therefore it is not highly preferred.

Mixtures of the preferred quaternary ammonium compounds can also be used as the preservative in the present invention.

When quaternary ammonium compounds are used as the preservative in the present invention, they are typically present at a level of from about 0.005% to about 0.2%, preferably from about 0.01% to about 0.1%, by weight of the usage composition.

Dehydroacetic Acid—A preferred preservative for use in the present invention is dehydroacetic acid. Dehydroacetic acid is a broad spectrum preservative preferably in the form of sodium or potassium salt so that it is water-soluble. This preservative acts more as a biostatic preservative than a biocidal preservative. When dehydroacetic acid is used as the preservative it is typically used at a level of from about 0.005% to about 0.2%, preferably from about 0.008% to about 0.1%, more preferably from about 0.01% to about 0.05%, by weight of the usage composition.

Phenyl and Phenolic Compounds—Some non-limiting examples of phenyl and phenolic compounds suitable for use in the present invention are:

One suitable phenolic compound is 4,4'-diamidino-α,ω-diphenoxypropane diisethionate, commonly known as propamidine isethionate, with water solubility of about 16%; and 4,4'-diamidino-α,ω-diphenoxyhexane diisethionate, commonly known as hexamidine isethionate. Typical effective level of these salts is about 0.0002% to about 0.05% by weight of the usage composition.

Other examples are benzyl alcohol, with a water solubility of about 4%; 2-phenylethanol, with a water solubility of about 2%; and 2-phenoxyethanol, with a water solubility of about 2.67%; typical effective level of these phenyl and phenoxy alcohol is from about 0.1% to about 0.5%, by weight of the usage composition.

Mixtures Thereof—The preservatives of the present invention can be used in mixtures in order to control a broad range of microorganisms.

Bacteriostatic effects can sometimes be obtained for aqueous compositions by adjusting the composition pH to an acid pH, e.g., less than about pH 4, preferably less than about pH 3, or a basic pH, e.g., greater than about 10, preferably greater than about 11.

Insect and/or Moth Repelling Agent—The composition of the present invention can optionally contain an effective amount of insect and/or moth repelling agents. Typical insect and moth repelling agents are pheromones, such as anti-aggregation pheromones, and other natural and/or synthetic ingredients. Preferred insect and moth repellent agents useful in the composition of the present invention are perfume ingredients, such as citronellol, citronellal, citral, linalool, cedar extract, geranium oil, sandalwood oil, 2-(diethylphenoxy)ethanol, 1-dodecene, etc. Other examples of insect and/or moth repellents useful in the composition of the present invention are disclosed in U.S. Pat. Nos. 4,449,987; 4,693,890; 4,696,676; 4,933,371; 5,030,660; 5,196,200; and in "Semio Activity of Flavor and Fragrance Molecules on Various Insect Species", B. D. Mookherjee et al., published in Bioactive Volatile Compounds from Plants, ASC Symposium Series 525, R. Teranishi, R. G. Buttery, and H. Sugisawa, 1993, pp. 35–48, all of said patents and publications being incorporated herein by reference. When an insect and/or moth repellent are used it is typically present at a level of from about 0.005% to about 3%, by weight of the usage composition.

Other Ingredients—The compositions may further comprise one or more adjuvants selected from the following: polysaccharides, bactericides, dyes, antifungal or mildew control agents, insect repellents, processing aids, anti-corrosive aids, stabilizers and antioxidants. A wide variety of other ingredients useful in detergent compositions can be included in the compositions herein, including other active ingredients, antioxidants, processing aids, dyes or pigments, solvents for liquid formulations, etc.

Usual ingredients can include one or more materials for assisting or enhancing performance, treatment of the substrate to be smoothed or de-wrinkled, or to modify the aesthetics of the composition. Usual adjuncts compositions include the ingredients set forth in U.S. Pat. No. 3,936,537, Baskerville et al. Adjuncts that can also be used in the compositions employed in the present invention include other active ingredients such as solubilizing agents, processing aids, pigments, fabric softeners, static control agents, etc. An antioxidant can be optionally added to the detergent compositions of the present invention. They can be any conventional antioxidant used in detergent compositions, such as 2,6-di-tert-butyl-4-methylphenol (BHT), carbamate, ascorbate, thiosulfate, monoethanolamine(MEA), diethanolamine, triethanolamine, etc. The antioxidant, when used, is present in an effective amount. It is preferred that the ultrasonic transmission fluid comprises at least about 0%, more preferably at least about 0.01%, even more preferably, at least about 0.01% even more preferably still, at least about 0.02% by weight of ultrasonic transmission fluid of antioxidant. The ultrasonic transmission fluid will also preferably contain no more than about 15%, more preferably no more than about 10%, even more preferably, no more than about 5%, even more preferably still, no more than about 2% by weight of ultrasonic transmission fluid of antioxidant.

The compositions of this invention may be in the form, of a liquid, gel, liqui-gel, microemulsion or tricritical composition. Highly preferred embodiments are in liquid or gel form.

The following Examples further illustrate the present invention, but are not intended to be limiting thereof.

EXAMPLES

Example 1

| Ingredient | % by weight |
|---|---|
| Preservative | 0.01 |
| HCl | 0.003 |
| Hydroxypropyl Beta Cyclodextrin | 0.35 |
| Isostearamidopropyl Betaine | 0.25 |
| Silwet L7657 | 0.25 |
| Silwet L7200 | 1.00 |
| Diethylene Glycol | 0.10 |
| Perfume | 0.05 |
| Water and minors | q.s to 100% |

Example 2

| Ingredient | % in formula |
|---|---|
| Preservative | 0.01 |
| NaOH | 0.038 |
| Hydroxypropyl Beta Cyclodextrin | 0.35 |
| Silwet L7657 | 0.25 |
| Diethylene Glycol | 0.10 |
| Perfume | 0.05 |
| PAA Polymer (MW 50M–300M) | 0.40 |
| Water and minors | q.s to 100% |

Example 3

| Ingredient | % in formula |
|---|---|
| Silwet L7200 | 1.00 |
| Silwet L7600 | 0.20 |
| Preservative | 0.01 |
| CAE-10 | 0.05 |
| Water and minors | q.s to 100% |

Example 4

| Ingredient | % in formula |
|---|---|
| Starch | 5.00 |
| Preservative | 0.01 |
| Water and minors | q.s to 100% |

Having thus described the invention in detail, it will be apparent to those skilled in the art that various changes may be made without departing from the scope of the invention and the invention is not to be considered limited to what is described in the specification.

What is claimed is:

1. A method for smoothing and de-wrinkling a discrete fabric item comprising the steps of applying to said discrete fabric item an effective amount of an ultrasonic transmission fluid and concurrent with or subsequent to said application of said ultrasonic transmission fluid, applying a source of ultrasonic energy to said ultrasonic transmission fluid, wherein said source of ultrasonic energy is applied in a manner which avoids fiber-damaging heat which could scorch, shine or flatten fabric, wherein the source of ultrasonic energy includes means to prevent the generation of heat said means selected from the group consisting of temperature means, and electronic means.

2. A method for smoothing and dc-wrinkling a discrete fabric item comprising at least the steps of applying to said discrete fabric item a quantity of an ultrasonic transmission fluid which is from about 1% to about 200% the dry weight of said discrete fabric item and concurrent with or subsequent to applying a source of ultrasonic energy to said ultrasonic transmission fluid, wherein said source of ultrasonic energy is applied in a manner which voids fiber-damaging heat which could scorch, shine or flatten fabric, wherein the source of ultrasonic energy includes means to prevent the generation of heat said means selected from the group consisting of temperature means.

3. The method according to any one of claims 1 or 2, wherein said ultrasonic transmission fluid comprises an ultrasonic carrier and optionally, an ultrasonic adjuvant.

4. The method according to claim 3, wherein said ultrasonic carrier is selected from the group consisting of alcohol, water, and mixtures thereof.

5. The method according to claim 3, wherein said ultrasonic adjuvant is selected from the group consisting of wetting agents, perfume, antibacterial agent, anti-oxidants, electrolytes, corrosion inhibitors, solvents, chelants, photobleaches, brighteners, hydrotropes, malodor control agents, and mixtures thereof.

6. The method according to claim 1, further comprising the step of placing said discrete fabric item on a surface that does not adsorb or dissipate the ultrasonic energy.

7. The method according to claim 1, wherein said process is conducted on said discrete fabric item that is being worn by a human being.

8. A Discrete fabric that has been smoothed and dc-wrinkled according to the process of claim 1.

9. A garment smoothing and dc-wrinkling product which smoothes and de-wrinkles garments without using fiber damaging heat which could scorch, shine or flatten garments comprising:

(a) ultrasonic transmission fluid, comprising an ultrasonic carrier and optionally, an ultrasonic adjuvant;

(b) an ultrasonic wave generating source for imparting ultrasonic waves onto wrinkles in said garments; and (c) instructions for using said product comprising the steps of:

(i) applying an effective amount of said ultrasonic transmission fluid to said wrinkles; and (ii) imparting ultrasonic waves to said wrinkles using said ultrasonic source in a manner that avoids fiber-damaging heat that could scorch, shine or flatten fabric, wherein means to avoid fiber-damaging heat is selected from the group consisting of temperature means, pressure means, and electronic means.

10. The garment smoothing and dc-wrinkling product of claim 9 wherein said ultrasonic transmission fluid and said ultrasonic soiree contained together in a device that permits controlled dispensing of said ultrasonic transmission fluid to the wrinkle while concurrently imparting ultrasonic waves thereto.

11. The garment smoothing and de-wrinkling product of claim 9, wherein said ultrasonic carrier is selected from the group consisting of alcohol, water, and mixtures thereof.

12. The garment smoothing and de-wrinkling product of claim 9, wherein said ultrasonic adjuvant is selected from the group consisting of selected from the group consisting of wetting agents, perfume, insect and moth repelling agents, antibacterial agent, anti-oxidants, electrolytes, polymeric dispersing agents, corrosion inhibitors, solvents, chelants, photobleaches, brighteners, hydrotropes, finishing agents, odor control agents, and mixtures thereof.

13. A process for restoring the appearance of fabrics by removing and/or restoring microfibrils to macrofibres of a fabric article comprising the steps of:

(a) applying an effective amount of an ultrasonic transmission fluid to said fabrics; and (b) imparting sonic or ultrasonic waves to said fabrics in a manner which avoids fiber-damaging heat which could scorch, shine or flatten fabric, wherein the means in which fiber-damaging heat is avoided is means selected from the group consisting of temperature means, pressure means, and electronic means;

wherein said fabrics contains from about 1% to about 200% the dry weight of said fabrics of ultrasonic transmission fluid.

14. An ultrasonic de-wrinkling apparatus comprising:

a plate;

ultrasonic means attached to said plate for generating ultrasonic waves in said plate;

a housing attached to said plate having handle means for grasping said housing and moving said housing and said plate;

means to prevent the generation of heat in said plate by said moving of said plate on said fabric, wherein said means of preventing the generation of heat is selected from the group consisting of temperature means, pressure means, and electronic means; at least one solution storage means associated with said de-wrinkling apparatus, said solution storage means being adapted to contain an ultrasonic transmission fluid; and at least one dispensing means mounted in said hewing, said dispensing means being in fluid communication with said storage means and is adapted to dispense said ultrasonic transmission fluid from solution storage means to a fabric surface.

15. The ultrasonic de-wrinkling apparatus according to claim 14, wherein said wherein said solution storage means is adapted to be removably mounted to said housing.

16. The ultrasonic de-wrinkling apparatus according to claim 14, wherein said solution storage means is mounted in said housing.

17. A method for smoothing and de-wrinkling a discrete fabric item comprising the steps of applying to said discrete fabric item un effective amount of an ultrasonic transmission fluid and concurrent with or subsequent to said application of said ultrasonic transmission fluid, applying a source of ultrasonic energy to said ultrasonic transmission fluid, wherein said source of ultrasonic energy is an ultrasonic de-wrinkling apparatus according so claim 14 and is applied in a manner which avoids fiber-damaging heat which could scorch, shine or flatten fabric.

18. A discrete fabric that has been smoothed and dc-wrinkled according to the process of claim 17.

19. A garment smoothing and de-wrinkling product which smoothes and de-wrinkles garments without using fiber damaging heat which could scorch, shine or flatten garments comprising:

(a) ultrasonic transmission fluid, comprising an ultrasonic carrier and optionally, an ultrasonic adjuvant;

(b) an ultrasonic wave generating source for imparting ultrasonic waves onto wrinkles in said garments, wherein said ultrasonic wave generating source is an ultrasonic de-wrinkling apparatus according to claim 14; and (c) instructions far using said product comprising the steps of:

(i) applying an effective amount of said ultrasonic transmission fluid to said wrinkles; and (ii) imparting ultrasonic waves to said wrinkles using said ultrasonic source in a manner that avoids fiber-damaging heat that could scorch, shine or flatten fabric wherein the means in which fiber-damaging heal is avoided is a means selected from the group consisting of temperature means, pressure means, and electronic means.

20. A product for restoring the appearance of fabrics by removing and/or restoring microfibrils to macrofibres of a fabric article comprising:

(a) ultrasonic transmission fluid, comprising an ultrasonic carrier and, optionally, an ultrasonic adjuvant, (b) an ultrasonic ways generating source for imparting ultrasonic waves onto the fabrics; and (c) instructions for using the product comprising the steps of:

(i) applying an effective amount of an ultrasonic transmission fluid to the fabrics; and (ii) imparting ultrasonic waves to the fabrics using the ultrasonic source in a manner that avoids fiber-damaging heat that could scorch, shine or flatten fabric, wherein the means in which fiber-damaging heat is avoided is means selected from the group consisting of temperature means, pressure means, and electronic means.

* * * * *